US008468698B2

(12) United States Patent
Futagi et al.

(10) Patent No.: US 8,468,698 B2
(45) Date of Patent: Jun. 25, 2013

(54) SPINNING METHOD

(75) Inventors: Tsunenari Futagi, Tochigi (JP); Nobuyuki Kakiya, Tochigi (JP); Tadahisa Akiyama, Tochigi (JP); Ikuo Kato, Tochigi (JP); Akitoshi Uchiumi, Tochigi (JP); Shinichi Ohnaka, Tochigi (JP); Toshimasa Koshimizu, Tochigi (JP); Haruo Machida, Tochigi (JP); Yuji Matsumoto, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 537 days.

(21) Appl. No.: 12/833,367

(22) Filed: Jul. 9, 2010

(65) Prior Publication Data

US 2011/0010940 A1 Jan. 20, 2011

(30) Foreign Application Priority Data

| | | |
|---|---|---|
| Jul. 15, 2009 | (JP) | 2009-167190 |
| Sep. 9, 2009 | (JP) | 2009-208019 |
| Sep. 10, 2009 | (JP) | 2009-209382 |
| Oct. 8, 2009 | (JP) | 2009-234520 |

(51) Int. Cl.
*B23P 17/00* (2006.01)

(52) U.S. Cl.
USPC ..... 29/894.354; 29/894.35

(58) Field of Classification Search
USPC ..... 29/894.353, 894.354, 894.35; 72/70, 72/71, 72
See application file for complete search history.

(56) References Cited

U.S. PATENT DOCUMENTS

| | | | | |
|---|---|---|---|---|
| 4,962,587 | A * | 10/1990 | Ashley et al. | 29/894.35 |
| 6,189,357 | B1 * | 2/2001 | Baumgarten et al. | 72/70 |

FOREIGN PATENT DOCUMENTS

| | | |
|---|---|---|
| JP | 2000-288669 | 10/2000 |
| JP | 2001-47127 | 2/2001 |
| JP | 2004-314117 | 11/2004 |
| JP | 2008-105090 | 5/2008 |

* cited by examiner

*Primary Examiner* — David Bryant
*Assistant Examiner* — Ryan J Walters
(74) *Attorney, Agent, or Firm* — Rankin, Hill & Clark LLP

(57) ABSTRACT

A workpiece having a first constant diameter portion, a tapered reduced-diameter portion, a concave portion, a tapered increased-diameter portion, and a second constant diameter portion is formed by machining the tapered reduced-diameter portion, and then machining the tapered increased-diameter portion and the concave portion.

4 Claims, 11 Drawing Sheets

SPINNING METHOD

BACKGROUND OF THE INVENTION

1. Field of the Invention

The present invention relates to a spinning method for forming, at a side wall portion of a cylindrical workpiece, a concave portion dented radially inwardly of the cylindrical workpiece.

2. Related Art

Conventionally, as a wheel to which a tire for a vehicle such as an automobile is fitted, a two-piece wheel has been widely used. The two-piece wheel is provided in the following manner. A wheel rim (hereinafter also simply referred to as a "rim") substantially cylindrically formed from a plate-like material is combined with a wheel disc (hereinafter also simply referred to as a "disc") formed into a substantially disc-like shape, and the wheel rim and the wheel disc are connected to each other by welding, thus providing the two-piece wheel.

Of these two components, the rim is formed by reducing a diameter of an approximate center of the cylindrical workpiece, and by forming an outer surface thereof into a concave cross-sectional shape. The rim is fabricated in the following manner, for example. First, end faces of a rectangular plate material are butted against each other to provide a cylindrical workpiece (cylindrical body). The butted end faces are connected to each other by resistance welding, friction stir welding or the like. Next, this cylindrical workpiece is held at a die provided with a predetermined concave portion, and then spinning is performed on a side wall portion of the workpiece In this spinning method, a roller is pressed to the workpiece from its outer surface toward its inside while the workpiece is rotated, thereby reducing a diameter of the workpiece. Thus, a concave portion, which is referred to as a "drop portion", is formed in the side wall portion so as to be dented along a circumferential direction. In some cases, an end portion of the workpiece is bent to provide a curled portion.

A wheel can be obtained by inserting the foregoing disc into the rim fabricated in the above-described manner, and by connecting the disc and the rim by MIG welding and/or spot welding.

In the foregoing spinning method, ends of a workpiece are fixed to a die by a clamp and/or a plate, for example, so that the relative position of the workpiece, which is being machined, and the die will not be deviated. On the other hand, upon formation of a concave reduced-diameter portion in an approximate center of a workpiece by spinning, extension is caused in the workpiece along an axial direction. Therefore, JP-A-2000-288669 proposes a method in which while ends of a workpiece are fixed by a pair of plates, the distance between these plates is increased in a manner that follows extension caused during machining of the workpiece. In the method proposed in JP-A-2000-288669, the workpiece is sandwiched between the pair of plates, and in this state, a side wall portion of the workpiece is pressed by a roller. Then, with this pressing, a thickness of the cylindrical body, which has been pressed, is drawn. In other words, so-called "ironing" proceeds.

When end portions of a workpiece are clamped as described in JP-A-2000-288669, a plurality of clamp mechanisms are required in order to clamp each end portion. Therefore, a forming apparatus is complicated in structure, and in addition, capital investment is increased.

Further, in this method, positions of the plates have to be precisely controlled, which might result in a large-scale apparatus.

Besides, since forming cannot be performed on a clamped region, the degree of flexibility with respect to forming is low. Hence, it is difficult to obtain a formed article having a complicated shape.

Another example of spinning is described in JP-A-2004-314117.

Furthermore, in conventional spinning, a thin thickness portion disadvantageously occurs in a workpiece.

A change in workpiece plate thickness when a cylindrical workpiece is reduced in diameter will be described. FIG. 23 is a cross-sectional view illustrating structures of a workpiece Wu before machining and a workpiece Wp after machining. More specifically, FIG. 23 is a diagram illustrating an example in which spinning is performed on the cylindrical workpiece Wu, thereby forming the product Wp having a concave cross-sectional shape. In the spinning, while a roller R is pressed to the workpiece Wu in a radial direction with the workpiece Wu rotated around an axis parallel to an axial direction, the roller R is moved along the axial direction, thereby forming the product Wp.

Upon carrying out of the above-described spinning on the workpiece, each element of the workpiece is extended along the axial direction and is shrunk in the radial direction. Basically, the plate thickness of the workpiece is reduced upon extension of the workpiece along the axial direction, but the plate thickness of the workpiece is increased upon shrinkage of the workpiece in the radial direction because its circumferential length is shortened.

As described above, in accordance with the resulting cross-sectional shape, a reduction in diameter of the cylindrical workpiece causes: a portion in which the plate thickness is increased as a result of redundancy of material due to shrinkage of the workpiece in the radial direction; and a portion in which the plate thickness is reduced as a result of deficiency of material due to extension of the workpiece along the axial direction. For example, when a concave portion, having a narrow and deep cross-sectional shape as illustrated in FIG. 23, is formed in the workpiece, the plate thickness of a portion with the smallest diameter, indicated by the broken line in FIG. 23, tends to be reduced. Furthermore, in this portion, a region with a large curvature, indicated by alternate long and short dashed lines in FIG. 23, tends to be particularly reduced in plate thickness.

As described above, upon occurrence of a thin thickness portion in a product, the strength of the entire product is reduced. Therefore, in order to ensure a sufficient strength of a product, a thick workpiece has to be used in anticipation of a reduction in plate thickness, thus making it difficult to reduce product weight.

SUMMARY OF THE INVENTION

One or more embodiments of the present invention provide a spinning method capable of simplifying a structure of a machining apparatus by reducing the number of clamp mechanisms, and is also capable of increasing the degree of flexibility with respect to forming.

Moreover, one or more embodiments of the present invention provide a spinning method in which while a position of a workpiece is fixed by a simple structure, extension of the workpiece is allowed.

In addition, one or more embodiments of the present invention provide a spinning method capable of forming a product having no thin thickness portion.

According to one or more embodiments of the present invention, there is provided a spinning method for forming a concave portion dented in a radial direction of a cylindrical workpiece by pressing a spinning tool against a side wall portion of the cylindrical workpiece, the method including the steps of:

a) attaching the workpiece to a die including a first equal diameter portion having a constant diameter, a second equal diameter portion having a constant diameter and located away from the first equal diameter portion, a first inclined portion continuous with the first equal diameter portion, a second inclined portion continuous with the second equal diameter portion, a small diameter portion interposed between the first and second inclined portions and having a constant diameter, and a workpiece movement preventing portion for preventing a movement of the cylindrical workpiece from the first inclined portion toward the second inclined portion, the first inclined portion being reduced in diameter in a tapered manner as the first inclined portion goes away from the first equal diameter portion, the second inclined portion being increased in diameter in a tapered manner as the second inclined portion comes close to the second equal diameter portion;

b) pressing the spinning tool to a region of the workpiece, corresponding to the first inclined portion, and displacing the spinning tool from the first inclined portion toward the second inclined portion, thereby forming the region into a shape conforming to that of the first inclined portion;

c) pressing the spinning tool to a region of the workpiece, corresponding to the second inclined portion, and displacing the spinning tool from the second inclined portion toward the first inclined portion, thereby forming the region into a shape conforming to that of the second inclined portion; and d) pressing the spinning tool to a region of the workpiece, corresponding to the small diameter portion, and displacing the spinning tool, thereby forming the region into a shape conforming to that of the small diameter portion, and performing ironing on a thickness of the region by the spinning tool so that the thickness of the region is drawn, wherein the step b) is performed before the step c) and the step d), and the workpiece is thus provided with: a first constant diameter portion conforming to the first equal diameter portion; a tapered reduced-diameter portion having a shape conforming to that of the first inclined portion; a concave portion having a shape conforming to that of the small diameter portion; a tapered increased-diameter portion having a shape conforming to that of the second inclined portion; and a second constant diameter portion conforming to the second equal diameter portion.

In the above-described method, the region corresponding to the first inclined portion adjacent to an unclamped end portion side (first equal diameter portion side) of the cylindrical workpiece is formed first, and then the region corresponding the second inclined portion and the region corresponding to the small diameter portion are formed in no particular order. Furthermore, a thickness of the region corresponding to the first inclined portion may be drawn if necessary.

When the region corresponding to the first inclined portion is formed, the workpiece is pressed toward an end portion (second equal diameter portion) thereof at which the workpiece movement preventing portion is provided, and therefore, a movement of the workpiece, i.e., a positional deviation thereof with respect to the die, will not occur. Further, slipping of the workpiece is also prevented.

Furthermore, the thickness of the region corresponding to the small diameter portion having the smallest diameter is formed into a shape conforming to that of the small diameter portion, thus fitting the formed region to the small diameter portion. As a result, the positioning of the workpiece is firmly fixed.

Thereafter, if necessary, the thickness of the region of the workpiece, corresponding to the first inclined portion, is drawn toward the first constant diameter portion. As mentioned above, since the positioning of the workpiece has already been firmly fixed, a positional deviation of the workpiece with respect to the die is avoided also in this case.

As will be understood from the above description, the workpiece itself functions as a clamp in the foregoing method. Therefore, the number of clamp mechanisms can be reduced, thus making it possible to simplify a structure of a forming apparatus including the die.

Moreover, since it is unnecessary to clamp at least one end portion of the workpiece, the degree of flexibility of forming with respect to the one end portion is increased. Accordingly, a formed article having a more complicated shape is obtainable.

It should be noted that a clamp mechanism may be used as a preferred example of the workpiece movement preventing portion. Specifically, in this case, only one end portion of the workpiece, located at the second equal diameter portion, may be clamped by the clamp mechanism.

Furthermore, the die to be used may be provided with: a first tapered portion having a taper angle larger than that of the first inclined portion and located between the first inclined portion and the small diameter portion; and a second tapered portion having a taper angle larger than that of the second inclined portion and located between the small diameter portion and the second inclined portion.

In this case, a large taper angle reduced-diameter portion, having a taper angle larger than that of the tapered reduced-diameter portion, is formed in a region of the workpiece, corresponding to the first tapered portion, and a large taper angle increased-diameter portion, having a taper angle larger than that of the tapered increased-diameter portion, is formed in a region of the workpiece, corresponding to the second tapered portion. Thus, a region of the workpiece, ranging from the tapered reduced-diameter portion to the concave portion, can be gradually dented, and a region of the workpiece, ranging from the concave portion to the tapered increased-diameter portion, can be gradually raised. In other words, a so-called "gap amount" can be gradually changed; hence, as compared with a case where the tapered reduced-diameter portion, the concave portion and the tapered increased-diameter portion are directly continuous with each other, the thickness is drawn more easily. Consequently, thickness alignment of these regions is also easily carried out.

Preferred examples of formed products obtained by the above-described spinning method include a wheel rim.

In the above-described method, using the die including the first and second equal diameter portions, the first and second inclined portions and the small diameter portion, the region corresponding to the first inclined portion adjacent to the unclamped first equal diameter portion side of the cylindrical workpiece supported at the die is formed first; then, the region corresponding the second inclined portion and the region corresponding to the small diameter portion are formed in this order, and furthermore, the thickness of the region corresponding to the first inclined portion is drawn. In the final drawing process, the region formed into a shape conforming to that of the small diameter portion is fitted to the small diameter portion, and therefore, the positioning of the workpiece is firmly fixed. In other words, the workpiece itself serves as a clamp.

Accordingly, since it is unnecessary to clamp both of the first and second equal diameter portions, the structure of the forming apparatus including the die can be simplified.

Further, the degree of flexibility of forming with respect to the unclamped one end portion of the workpiece is increased. Accordingly, a formed article having a more complicated shape is obtainable.

Moreover, according to one or more embodiments of the present invention, a spinning method includes: a fixing step for fixing a cylindrical member (e.g., an after-mentioned workpiece W) to a die (e.g., a die including after-mentioned split dies 21 and 22) provided inwardly thereof; and a forming step for pressing a spinning tool (e.g., an after-mentioned roller R) to an outer surface of the cylindrical member toward a central axis (O) while rotating the cylindrical member together with the die, thereby forming the cylindrical member into a predetermined shape. In the fixing step, at least part of the cylindrical member is expanded, and the expanded part is supported at the die, thus fixing the cylindrical member at a predetermined position of the die.

In this method, when the cylindrical member is fixed at the predetermined position of the die, at least part of the cylindrical member is expanded, and the expanded part is supported at the die. The cylindrical member can be brought into intimate contact with the die by expanding the cylindrical member in this manner. Therefore, a frictional force acted between the cylindrical member and the die is utilized, and the cylindrical member can be fixed to the die without the use of any clamp. Further, the cylindrical member is fixed by utilizing the frictional force, thereby allowing the cylindrical member to be fixed at the predetermined position of the die without preventing extension of the cylindrical member. Furthermore, it is unnecessary to fix the cylindrical member to the die by a clamp, a plate or the like; hence, as compared with a conventional method, a cycle time can be reduced by a time required for attachment and detachment of the cylindrical member.

In this case, the die may include: a first split die (e.g., the after-mentioned first split die 21) with which an axial (O) one end side of the cylindrical member is brought into contact; and a second split die (e.g., the after-mentioned second split die 22) which is coaxial with the first split die and with which an axial other end side of the cylindrical member is brought into contact. In the first and second split dies, increased-diameter portions (e.g., after-mentioned first and second tapered portions 31 and 32), each having an outer diameter larger than an inner diameter of the cylindrical member, may be formed. In the fixing step, the first and second split dies may be inserted into the cylindrical member through the ends thereof, and end portions of the cylindrical member may be brought into intimate contact with the increased-diameter portions while being expanded by the respective increased-diameter portions of the first and second split dies.

In this method, the first and second split dies provided with the increased-diameter portions, each having an outer diameter larger than the inner diameter of the cylindrical member, are inserted into the cylindrical member through the ends thereof. Then, the end portions of the cylindrical member are brought into intimate contact with the increased-diameter portions while being expanded by the respective increased-diameter portions of the first and second split dies, thereby fixing the cylindrical member at the predetermined position of the dies. Thus, the cylindrical member can be fixed to the first and second split dies while being coaxial with the first and second split dies, and therefore, the cylindrical member can be always fixed at the same position with respect to the dies.

In this case, a drop portion (e.g., an after-mentioned drop portion 33), having a concave shape as viewed in cross section along an axial direction, may be formed between the increased-diameter portions of the first and second split dies of the die. The drop portion may include: a bottom face part (e.g., an after-mentioned bottom face part 34); and wall parts (e.g., after-mentioned first and second drop wall parts 35 and 36) formed at axial both sides of the bottom face part. The foregoing forming step may include: a first forming step of forming, using the spinning tool, a bottom face part (e.g., an after-mentioned bottom face part 94) in the cylindrical member along an outer surface of the bottom face part of the die; and a second forming step of forming, using the spinning tool, wall parts (e.g., after-mentioned drop wall parts 95 and 96) and increased-diameter portions (e.g., after-mentioned first and second tapered portions 91 and 92) in the cylindrical member in which the bottom face part has been formed, the wall parts being formed along the wall parts of the die, the increased-diameter portions being formed along the increased-diameter portions of the die. In the first forming step, a portion of the cylindrical member, which will serve as a material constituting the bottom face part, may be butted against the outer surface of the bottom face part of the die by the spinning tool, and then the portion butted against the outer surface of the bottom face part of the die may be extended along the axial direction by ironing, thereby forming the bottom face part in the cylindrical member. An insertion position of the spinning tool at the start of the first forming step may be a position (P2) at an intersection of: a straight line (L1) that starts from one end (P1) of the portion of the yet-to-be-ironed cylindrical member, butted against the outer surface of the bottom face part of the die, and that is substantially in parallel to the outer surface of one of the wall parts of the die; and the cylindrical member before forming.

In this method, the bottom face part is formed in the cylindrical member along the outer surface of the bottom face part of the die with the use of the spinning tool. Then, with the use of the spinning tool, the wall parts are formed in the cylindrical member along the outer surfaces of the wall parts of the die, and the increased-diameter portions are formed in the cylindrical member along the outer surfaces of the increased-diameter portions of the die. In this manner, before forming the wall parts and increased-diameter portions of the cylindrical member, the bottom face part thereof, which is the deepest part, is formed. Thus, the wall parts and increased-diameter portions of the cylindrical member can be formed with the cylindrical member fitted into the bottom face part of the die, and therefore, a positional deviation of the cylindrical member along the axial direction can be suppressed during forming. Since the cylindrical member is fixed to the die by utilizing a frictional force as mentioned above, the extension of the cylindrical member, which occurs along the axial direction in the first and second forming steps, will not be prevented, and in addition, a positional deviation of the cylindrical member along the axial direction is suppressed. Furthermore, since ironing is performed with the cylindrical member partially butted to the outer surface of the bottom face part of the die, a frictional force is acted between the cylindrical member and the die, and therefore, a positional deviation of the cylindrical member with respect to the die can be suppressed. Besides, the insertion position of the spinning tool at the start of the first forming step is determined as the position at an intersection of: the straight line that starts from one end of the portion of the yet-to-be-ironed cylindrical member, butted against the outer surface of the bottom face part of the die, and that is substantially in parallel to the outer surface of one of the wall parts of the die; and the cylindrical member before forming. In other words, the insertion position of the spinning tool at the start of the first forming step is equivalent to an end of a portion that becomes the drop portion as a result of the forming. Hence, the accuracy of material position management can be enhanced.

In this case, when drawing is performed on the cylindrical member in the second forming step, the spinning tool may be moved from the bottom face part of the cylindrical member toward an end portion thereof.

Upon carrying out of drawing on the cylindrical member in the spinning, i.e., upon pressing of the spinning tool against the cylindrical member, located above the surface of the die, toward the central axis, the cylindrical member tends to be extended in the same direction as the traveling direction of the spinning tool. Therefore, in this method, when the cylindrical member, in which the bottom face part has been formed by executing the first forming step, is subjected to drawing in the second forming step, the spinning tool is moved from the bottom face part of the cylindrical member toward the end portion thereof. Thus, the thickness, pulled toward both ends of the bottom face part of the cylindrical member when the bottom face part is formed in the first forming step, can be moved toward the wall parts and increased-diameter portions of the cylindrical member, and therefore, an excess thickness can be prevented.

In this case, when ironing is performed on the cylindrical member in the second forming step, the spinning tool may be moved from the end portion of the cylindrical member toward the bottom face part thereof.

Upon carrying out of ironing on the cylindrical member in the spinning, i.e., upon pressing of the spinning tool against the cylindrical member, coming into contact with the surface of the die, toward the central axis, the cylindrical member tends to be extended in the direction opposite to the traveling direction of the spinning tool. Therefore, upon carrying out of the ironing on the cylindrical member, in which the bottom face part has been formed, while the spinning tool is moved from the bottom face part toward the end portion when the wall parts and increased-diameter portions are formed at both sides of the bottom face part in the second forming step, the cylindrical member extends toward the bottom face part, which might cause buckling in the bottom face part of the cylindrical member and/or might cause the wall parts and increased-diameter portions of the cylindrical member to be rise from the surface of the die. To the contrary, when ironing is performed in the second forming step, the spinning tool is moved from the end portion of the cylindrical member toward the bottom face part thereof, thereby making it possible to adjust plate thicknesses of the wall parts and the increased-diameter portions while efficiently extending the cylindrical member along the axial direction. Further, at this time, buckling will not occur in the bottom face part, and the cylindrical member will not rise from the surface of the die.

In this case, the spinning tool may include first and second spinning tools; furthermore, when ironing is performed on the cylindrical member in the second forming step, the first spinning tool (e.g., an after-mentioned first roller R1) may be moved from the axial one end side of the cylindrical member toward the bottom face part thereof, and the second spinning tool (e.g., an after-mentioned second roller R2) may be moved from the axial other end side of the cylindrical member toward the bottom face part thereof, thereby forming the wall parts and the increased-diameter portions at both sides of the bottom face part.

As mentioned above, upon carrying out of ironing on the cylindrical member, in which the bottom face part has already been formed, while the spinning tool is moved from the bottom face part toward the end portion when the wall parts and increased-diameter portions are formed at both sides of the bottom face part in the second forming step, the thickness is concentrated toward the bottom face part, which becomes a cause of buckling of the bottom face part and rising of the wall parts. Therefore, according to this invention, the first and second spinning tools are moved from the end portions of the cylindrical member toward the bottom face part thereof, thereby making it possible to adjust the plate thicknesses of the wall parts and increased-diameter portions while efficiently extending the cylindrical member along the axial direction. Further, at this time, buckling will not occur in the bottom face part, and the cylindrical member will not rise from the surface of the die. Furthermore, the ironing is performed simultaneously using the two spinning tools, thereby making it possible to efficiently extend the cylindrical member toward the both ends thereof and to efficiently perform machining on the cylindrical member in a short time.

Moreover, according to one or more embodiments of the present invention, a spinning method for shrinking and forming a cylindrical member (e.g., an after-mentioned workpiece $W_o$) into a predetermined shape by pressing a spinning tool (e.g., an after-mentioned roller $R_o$) against the rotated cylindrical member, the method including: a first step of moving the spinning tool along an axial direction toward the other end while pressing the spinning tool against the cylindrical member toward a central axis (e.g., an after-mentioned axis O); a second step of stopping the movement of the spinning tool and getting the spinning tool away from the cylindrical member when the spinning tool reaches a specific region (e.g., an after-mentioned specific region P) of the cylindrical member, thus forming, in the specific region of the cylindrical member, a raised portion (e.g., an after-mentioned raised portion 397) raised radially outward; and a third step of moving the spinning tool along the axial direction while pressing the spinning tool against the cylindrical member toward the central axis to compress the raised portion, thereby increasing a thickness of the specific region of the cylindrical member.

In this method, the spinning tool is moved along the axial direction toward the other end while being pressed against the cylindrical member toward the central axis. When the spinning tool reaches the specific region of the cylindrical member, the movement of the spinning tool is stopped, and the cylindrical member goes away from the cylindrical member. Thus, the raised portion raised radially outward can be formed in the specific region of the cylindrical member. Then, the spinning tool is moved along the axial direction while being pressed against the cylindrical member toward the central axis, thereby compressing the raised portion. In this manner, the raised portion is formed so that the circumferential length of the specific region is increased, and the specific region is increased in diameter; then, the raised portion is compressed so that the circumferential length of the specific region is reduced again, and the specific region is reduced in diameter, thus making it possible to increase the thickness of the specific region in accordance with the temporary extension of the circumferential length. In this case, when a thin thickness portion might occur in a resulting product, i.e., when a portion whose plate thickness is reduced upon carrying out of spinning on the cylindrical member might occur, a portion of the cylindrical member, which might become a thin thickness portion, is determined as the specific region, and this specific region is increased in thickness by the foregoing procedure. In anticipation of a plate thickness reduction resulting from the forming, the foregoing thickening machining is performed on the cylindrical member at an early forming stage prior to the forming of the cylindrical member into a product shape, thereby allowing the plate thickness of the resulting product to be uniformized. Furthermore, since no thin thickness portion occurs in the resulting product, a cylindrical member having a plate thickness smaller than that of a conventional one can be used while necessary strength is ensured.

In this case, when the spinning tool is moved along the axial direction in the foregoing first, second and third steps, the cylindrical member may be compressed along the axial direction.

According to the embodiment, in the first and second steps, the spinning tool is moved along the axial direction while the cylindrical member is compressed, thus facilitating the formation of the raised portion at a spinning tool movement destination, i.e., in the specific region of the cylindrical member. Furthermore, in the third step, a material constituting the raised portion can be restrained within the specific region by compressing the cylindrical member along the axial direction. Therefore, when the raised portion is compressed and shrunk toward the central axis, the thickness of the specific region can be more reliably increased.

Other aspects and advantages of the invention will be apparent from the following description, the drawings and the claims.

DETAILED DESCRIPTION OF THE EXEMPLARY EMBODIMENTS

Hereinafter, exemplary embodiments of spinning methods according to the present invention will be described in detail with reference to the accompanying drawings.

First Exemplary Embodiment

Figure 1:
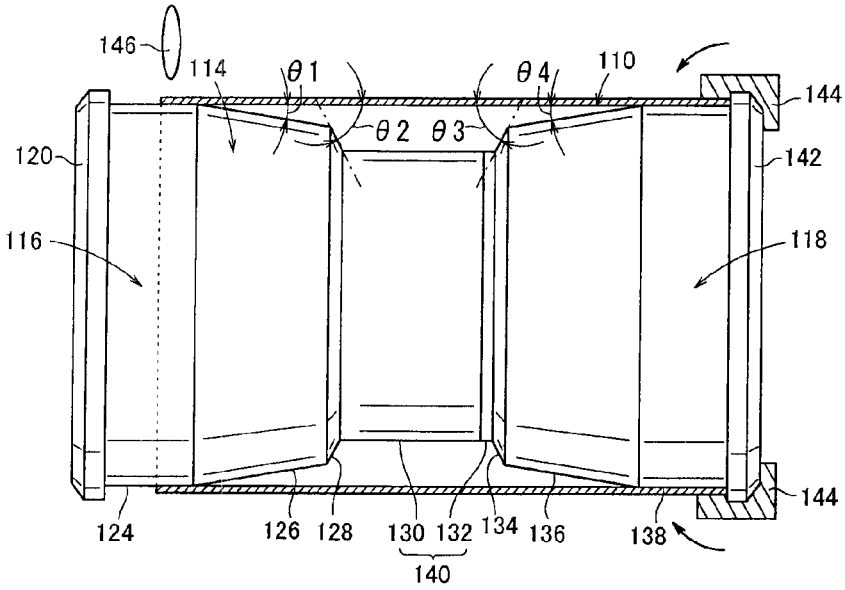
FIG. 1 is an overall schematic side view, partially in cross section, illustrating a die included in a forming apparatus for performing a spinning method according to a first exemplary embodiment of the present invention.
Figure 5:
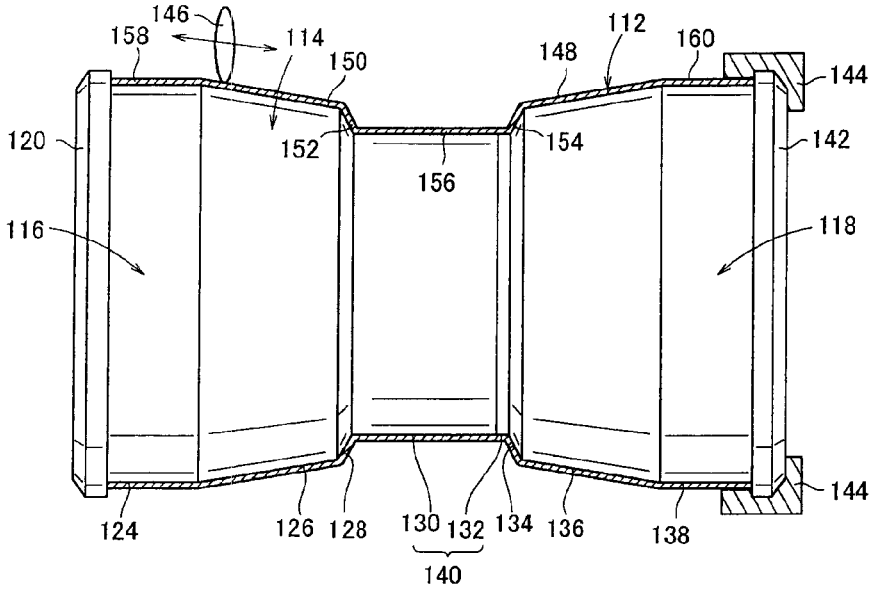
FIG. 5 is an overall schematic side view, partially in cross section, illustrating a state in which the roller is further returned from its position illustrated in FIG. 4, and ironing is performed on the region of the workpiece, which has been formed into a shape conforming to that of the first inclined portion.

FIG. 1 is an overall schematic side view, partially in cross section, illustrating a die 114 included in a forming apparatus for performing a spinning method according to a first exemplary embodiment on a cylindrical body 110, serving as a cylindrical workpiece, thereby obtaining a rim 112 (see FIG. 5). This die 114 is provided by combining a left mandrel 116 and a right mandrel 118 with each other.

The left mandrel 116 is provided with a disc-like left stopping plate 120 for stopping the cylindrical body 110. Naturally, a diameter of the left stopping plate 120 is set to be larger than that of the cylindrical body 110.

In this case, the left mandrel 116 is provided with: a first equal diameter portion 124 having a constant diameter; a first inclined portion 126 continuous with the first equal diameter portion 124 and reduced in diameter radially inward in a tapered manner; a first tapered portion 128 continuous with the first inclined portion 126 and reduced in diameter in a tapered manner at a taper angle larger than that of the first inclined portion 126; and a first small diameter part 130 continuous with the first tapered portion 128 and having a constant diameter. These elements are provided in the above order from the left side of FIG. 1

As will be easily understood from FIG. 1, a diameter of the first small diameter part 130 is smaller than that of the first equal diameter portion 124. Further, a taper angle θ1 of the first inclined portion 126 and a taper angle θ2 of the first tapered portion 128 have the following relationship: θ1<θ2.

On the other hand, the right mandrel 118 is provided with: a second small diameter part 132 having a diameter equal to that of the first small diameter part 130; a second tapered portion 134 continuous with the second small diameter part 132 and increased in diameter radially outward in a tapered manner at a angle θ3; a second inclined portion 136 continuous with the second tapered portion 134 and tapered at a taper angle θ4 smaller than the angle θ3 of the second tapered portion 134; and a second equal diameter portion 138 continuous with the second inclined portion 136 and having a constant diameter. These elements are provided in the above order from the left side of FIG. 1.

That is to say, in the die 114 used in the first exemplary embodiment, there exist the first equal diameter portion 124, the first inclined portion 126, the first tapered portion 128, a small diameter portion 140 formed by the first and second small diameter parts 130 and 132 continuous with each other, the second tapered portion 134, the second inclined portion 136, and the second equal diameter portion 138 in this order from the left side of FIG. 1.

In this case, the second equal diameter portion 138 has a diameter equal to that of the first equal diameter portion 124. Further, the diameter of each of these first and second equal diameter portions 124 and 138 is substantially equal to an inner diameter of the cylindrical body 110.

On the other hand, the taper angle θ2 of the first tapered portion 128 and the taper angle θ3 of the second tapered portion 134 may be equal to each other, or may be different from each other. Similarly, the taper angle θ1 of the first inclined portion 126 and the taper angle θ4 of the second inclined portion 136 may be equal to each other, or may be different from each other.

The right mandrel 118 is provided with a disc-like right stopping plate 142 for stopping the cylindrical body 110 drawn by ironing. Similarly to the left stopping plate 120, a diameter of the right stopping plate 142 is set to be larger than that of the cylindrical body 110.

At the right stopping plate 142, a plurality of clamp claws 144, constituting a clamp mechanism (workpiece movement preventing portion) for preventing a movement of the cylindrical body 110 along an axial direction of the die 114, are annularly arranged and provided so as to be openable/closable. It should be noted that two of the clamp claws 144 are illustrated in FIG. 1.

The die 114 provided as described above is rotatable around its central axis under action of an unillustrated rotation mechanism included in the forming apparatus.

The forming apparatus further includes a roller 146 that can be brought close to and separated from a side wall portion of the die 114. The roller 146 may also be displaced along a longitudinal direction of the die 114 under action of an unillustrated displacement mechanism. As will be described later, the roller 146 is displaced along a longitudinal direction of the cylindrical body 110 while the roller 146 presses the cylindrical body 110 toward the die 114, thereby performing spinning.

Using the forming apparatus including the die 114 and roller (spinning tool) 146 provided as described above, a spinning method according to the first exemplary embodiment is performed as follows.

First, a rectangular plate material made of light alloy, iron or the like, for example, is bent to allow end faces thereof to be butted against each other, and the butted end faces are connected to each other by resistance welding, friction stir welding or the like, thereby providing the cylindrical body 110.

A right end face of the cylindrical body 110 formed as described above and illustrated in FIG. 1 is butted against an end face of the right stopping plate 142. Then, the clamp claws 144 constituting the clamp mechanism are closed, thus clamping only a right end portion of the cylindrical body 110. It should be noted that the broken line illustrated in FIG. 1 indicates the position of a left end face of the cylindrical body 110, and the same goes for the following drawings. At this point in time, the left end face of the cylindrical body 110 reaches the first equal diameter portion 124.

In this state, the roller 146 is pressed to a region of the cylindrical body 110, substantially corresponding to the first inclined portion 126. Thereafter, the die 114 and the cylindrical body 110 are rotated under action of the foregoing rotation mechanism.

Figure 2:
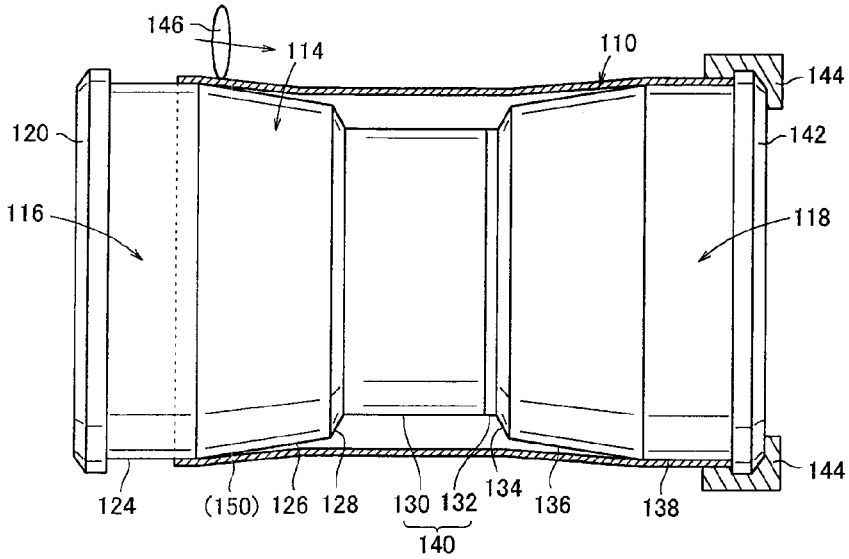
FIG. 2 is an overall schematic side view, partially in cross section, illustrating a state in which a roller is displaced from its position illustrated in FIG. 1, and forming is started on a region of a cylindrical workpiece (cylindrical body), corresponding to a first inclined portion.

Next, the roller 146 is displaced toward the small diameter portion 140. At this time, the cylindrical body 110 is deformed along a shape of the first inclined portion 126. As a result, as illustrated in FIG. 2, formation of a tapered reduced-diameter portion 150, having a shape conforming to that of the first inclined portion 126, is started in the cylindrical body 110.

In this case, with the displacement of the roller 146 toward the small diameter portion 140, the cylindrical body 110 is pressed toward the second equal diameter portion 138. However, the end portion of the cylindrical body 110, adjacent to the second equal diameter portion 138, is clamped by the clamp claws 144 and stopped by the right stopping plate 142 as mentioned above. Therefore, a positional deviation of the cylindrical body 110 with respect to the die 114 will be avoided.

Furthermore, a rotation along a circumferential direction of the die 114, i.e., slipping, will not occur in the clamped cylindrical body 110 stopped by the right stopping plate 142.

The roller 146 goes beyond the first tapered portion 128, the small diameter portion 140 and the second tapered portion 134, and reaches a position close to a boundary between the second inclined portion 136 and the second equal diameter portion 138. If necessary, the roller 146 may be allowed to run on a region of the cylindrical body 110, corresponding to the second equal diameter portion 138, and may be allowed to reach a position close to the clamp claw 144. Thus, a second constant diameter portion 160 corresponding to the second equal diameter portion 138 is formed in the cylindrical body 110.

Figure 3:
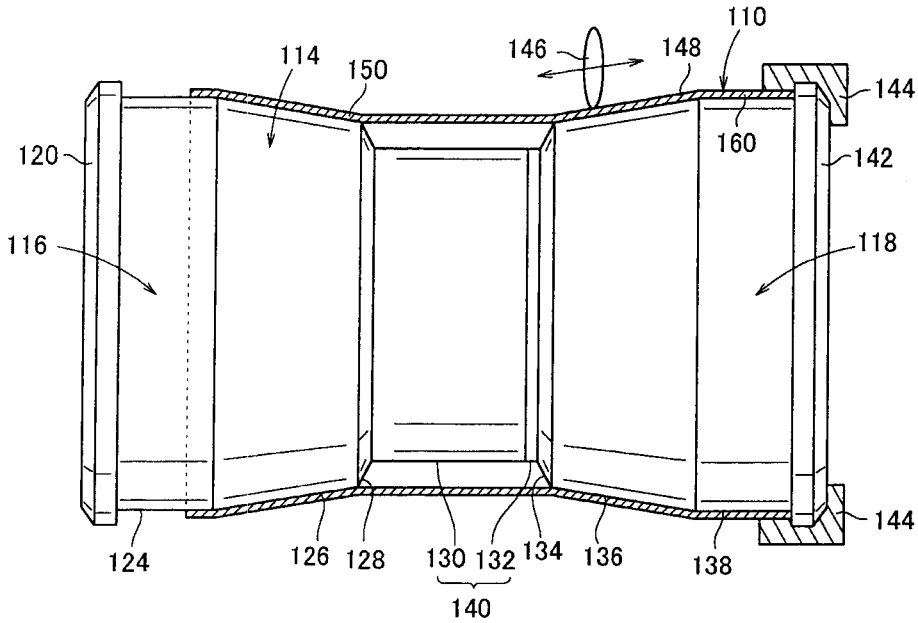
FIG. 3 is an overall schematic side view, partially in cross section, illustrating a state in which the roller is further displaced toward a clamped end portion of the workpiece.

Thereafter, as illustrated in FIG. 3, the roller 146 is reciprocated on a region of the cylindrical body 110, corresponding to the second inclined portion 136, thereby forming this region into a shape conforming to that of the second inclined portion 136. At this time, the thickness of this region is drawn. That is to say, in the first exemplary embodiment, this region is formed into a shape conforming to that of the second inclined portion 136 of the die 114, and ironing, which entails thinning, is performed on this region. As a result, a tapered increased-diameter portion 148 is formed to an appropriate thickness in the cylindrical body 110.

As illustrated in FIGS. 1 to 3, a left end portion of the cylindrical body 110 is not clamped. In other words, the left end portion is a so-called "free end". Accordingly, when the above-mentioned drawing proceeds, a right end portion side thickness of the cylindrical body 110 is thinned while being drawn toward the left end portion. At this time, under clamping action of the clamp claws 144, a movement of the cylindrical body 110 toward the left end portion is avoided. In other words, the cylindrical body 110 is prevented from causing a positional deviation. At the same time, slipping of the cylindrical body 110 is effectively prevented.

Figure 4:
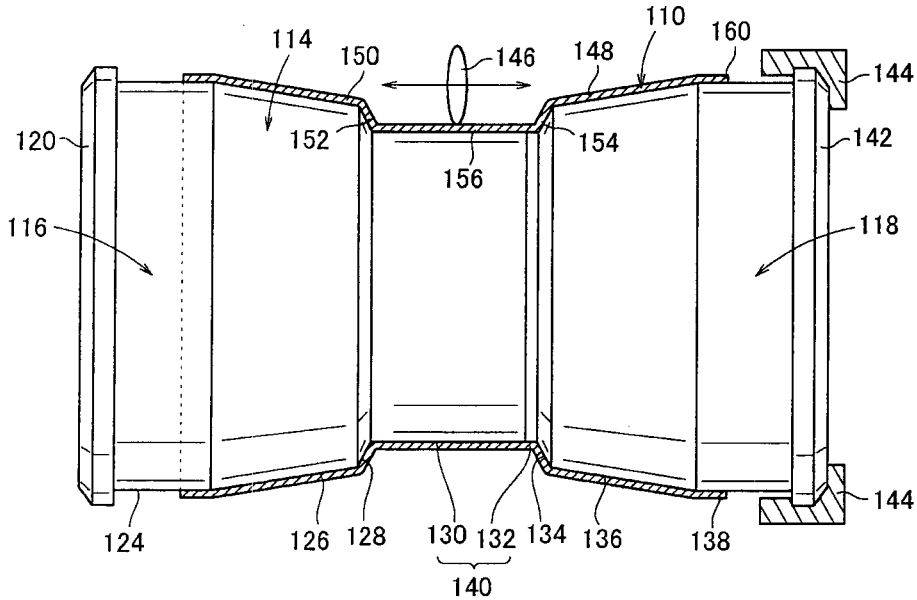
FIG. 4 is an overall schematic side view, partially in cross section, illustrating a state in which the roller is returned from its position illustrated in FIG. 3, and forming is performed on a region of the workpiece, corresponding to a small diameter portion.

Next, after passage along the second tapered portion 134, the roller 146 reaches a region of the cylindrical body 110, corresponding to the small diameter portion 140, as illustrated in FIG. 4. With this passage, a large taper angle increased-diameter portion 154, having a taper angle corresponding to that of the second tapered portion 134, is formed in the cylindrical body 110.

As illustrated in FIG. 4, the roller 146, which has reached the small diameter portion 140, is reciprocated so as to be moved from the first tapered portion 128 toward the second tapered portion 134 or in the opposite direction. In accordance with this reciprocation, the region of the cylindrical body 110, corresponding to the small diameter portion 140, is deformed into a shape conforming to that of the small diameter portion 140. Thus, a portion of the cylindrical body 110, located substantially in the middle of its height direction, is reduced in diameter, resulting in formation of a constant-diameter concave portion 156 having a diameter corresponding to that of each of the first and second small diameter parts 130 and 132.

During the reciprocation of the roller 146, since an inner wall of the concave portion 156 butts against the first and second small diameter parts 130 and 132, the concave portion 156 cannot be further reduced in diameter, and therefore, the thickness of the concave portion 156 is drawn while being thinned. In other words, the thickness of the concave portion 156 is optimized. Furthermore, with this optimization, the concave portion 156 of the cylindrical body 110 is fitted to the small diameter portion 140. It should be noted that the thickness drawn at this time is moved toward the left end portion serving as a free end.

Next, as illustrated in FIG. 5, the roller 146 goes beyond the first tapered portion 128 from the small diameter portion 140, and is displaced so as to be returned to the first inclined portion 126. Due to this displacement, a large taper angle reduced-diameter portion 152 is formed in a region of the cylindrical body 110, corresponding to the first tapered portion 128.

As illustrated in FIG. 5, the roller 146, which has reached the first inclined portion 126, is reciprocated so as to be moved from the first equal diameter portion 124 toward the first tapered portion 128 or in the opposite direction. Thus, the thickness of the tapered reduced-diameter portion 150, which has already been formed, is drawn and thinned. In other words, the thickness of the tapered reduced-diameter portion 150 is optimized.

As mentioned above, the concave portion 156 of the cylindrical body 110 is fitted to the small diameter portion 140 of the die 114. Therefore, when ironing is performed on the tapered reduced-diameter portion 150, the cylindrical body 110 avoids being pulled toward the first equal diameter portion 124. In other words, also in this case, occurrence of a positional deviation of the cylindrical body 110 with respect to the die 114 is prevented.

With further displacement of the roller 146 toward the first equal diameter portion 124, the thickness of the cylindrical body 110, drawn from the tapered reduced-diameter portion 150, reaches the first equal diameter portion 124. Eventually, this thickness is stopped by the left stopping plate 120, thereby forming a first constant diameter portion 158, corresponding to the first equal diameter portion 124, to a predetermined thickness in the cylindrical body 110.

Thus, there is formed the rim 112 having the first constant diameter portion 158, the tapered reduced-diameter portion 150, the large taper angle reduced-diameter portion 152, the equal-diameter concave portion 156, the large taper angle increased-diameter portion 154, the tapered increased-diameter portion 148, and the second constant diameter portion 160 in this order from the left side of FIG. 5.

After the roller 146 has been displaced in a direction in which the roller 146 goes away from the die 114, the rotation of the die 114 is stopped. Furthermore, upon opening of the clamp claws 144, the rim 112 formed as described above is disengaged from the die 114.

As described above, according to the first exemplary embodiment, forming is performed on the cylindrical body 110 from the clamped right end portion of the cylindrical body 110 toward the unclamped left end portion thereof. Therefore, the optimization of thickness of the cylindrical body 110 (rim 112) is enabled.

Further, the large taper angle reduced-diameter portion 152 is interposed between the tapered reduced-diameter portion 150 and the concave portion 156, and the large taper angle increased-diameter portion 154 is interposed between the concave portion 156 and the tapered increased-diameter portion 148. Hence, the amount of a gap between the tapered reduced-diameter portion 150 and the concave portion 156, and the amount of a gap between the concave portion 156 and the tapered increased-diameter portion 148 can be gradually changed. Accordingly, as compared with a case where the tapered reduced-diameter portion 150 and the concave portion 156 are directly continuous with each other and the concave portion 156 and the tapered increased-diameter portion 148 are directly continuous with each other, the thickness is drawn more easily, and therefore, thickness alignment is also easily carried out.

Due to the optimization of the thickness of the rim 112, the existence of a region whose thickness is excessively small will be avoided in the rim 112. Accordingly, the rim 112 exhibits a high rigidity across all of its regions.

Furthermore, since the thickness is optimized, it is unnecessary to use a thick plate material. Therefore, a reduction in weight of the rim 112 is enabled, and a reduction in material cost can be achieved.

Moreover, as will be understood from the above description, one end portion of the cylindrical body 110 does not have to be clamped, thus reducing the number of the clamp claws 144 and eventually reducing the number of clamp mechanisms. Accordingly, the structure of the forming apparatus can be simplified. Besides, since the degree of flexibility of forming with respect the one end portion is increased, the cylindrical body 110 can be formed into a more complicated shape.

It should be noted that the first exemplary embodiment uses the die 114 in which the first tapered portion 128 exists between the first inclined portion 126 and the small diameter portion 140 and the second tapered portion 134 exists between the small diameter portion 140 and the second inclined portion 136. However, the die may be one in which the first tapered portion 128 does not exist between the first inclined portion 126 and the small diameter portion 140, or may be one in which the second tapered portion 134 does not exist between the small diameter portion 140 and the second inclined portion 136. Naturally, the die may alternatively be one in which both of the first and second tapered portions 128 and 134 do not exist.

Further, the workpiece movement preventing portion is not particularly limited to the clamp mechanism. For example, the right stopping plate 142 may be used as the workpiece movement preventing portion.

In this case, with the movement of the roller 146 from the first inclined portion 126 toward the second inclined portion 136, the cylindrical body 110 is pressed against the right stopping plate 142. Accordingly, also in the cylindrical body 110, the right end portion of which is not clamped, slipping will not occur.

Moreover, in the above description, the machining of the region of the cylindrical body 110, corresponding to the second inclined portion 136, is performed, and then the machining of the region corresponding to the small diameter portion 140 is performed. However, the machining may be performed in the opposite order. In other words, after the machining of the region corresponding to the small diameter portion 140 has been performed, the machining of the region corresponding to the second inclined portion 136 may be performed.

Furthermore, although the case in which the rim 112 is obtained has been described by way of example in the first exemplary embodiment, a formed article to be obtained may be any article.

Second Exemplary Embodiment

Figure 6:
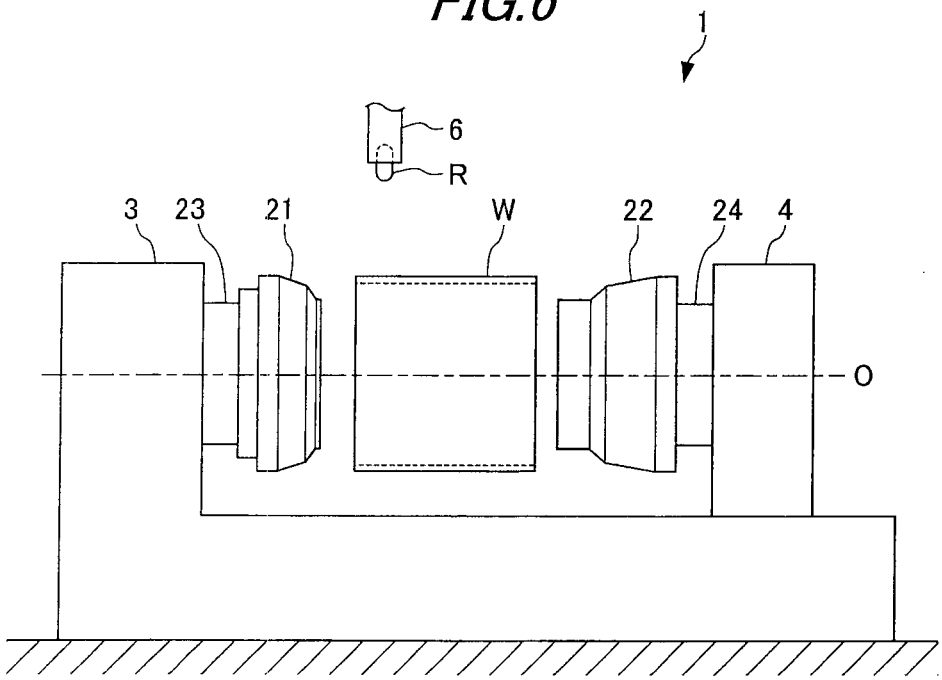
FIG. 6 is a schematic diagram illustrating a structure of a spinning system to which a spinning method according to a second exemplary embodiment of the present invention is applied.

FIG. 6 is a schematic diagram illustrating a structure of a spinning system 1 to which a spinning method according to a second exemplary embodiment of the present invention is applied.

The spinning system 1 includes: first and second split dies 21 and 22 for holding a cylindrical workpiece W; a rotating device 3 for rotating the workpiece W; a compressing device 4 for compressing the workpiece W; a roller moving device 6 for moving a roller (spinning tool) R; and a control board (not illustrated) for controlling the entire system.

As will be described in detail below, in the spinning system 1, the roller R is brought into contact with an outer surface of the workpiece W rotated around an axis O serving as a central axis, thereby shrinking the workpiece W and forming the workpiece W into a shape along outer surfaces of the split dies 21 and 22. A cylindrical body, fabricated by shrinking the workpiece W using the spinning system 1, is used for an automobile wheel rim, for example.

The first and second split dies 21 and 22 are provided at the left side of FIG. 6 and the right side of FIG. 6, respectively, along the same axis O. The outer surface of the first split die 21 has a shape conforming to a left side shape of a wheel rim, and the outer surface of the second split die 22 has a shape conforming to a right side shape of the wheel rim. Accordingly, the dies 21 and 22 are butted against each other, thereby providing a die having a shape conforming to that of the wheel rim. The first split die 21 is connected to the rotating device 3 via a support strut 23, and the second split die 22 is connected to the compressing device 4 via a support strut 24.

Figure 7:
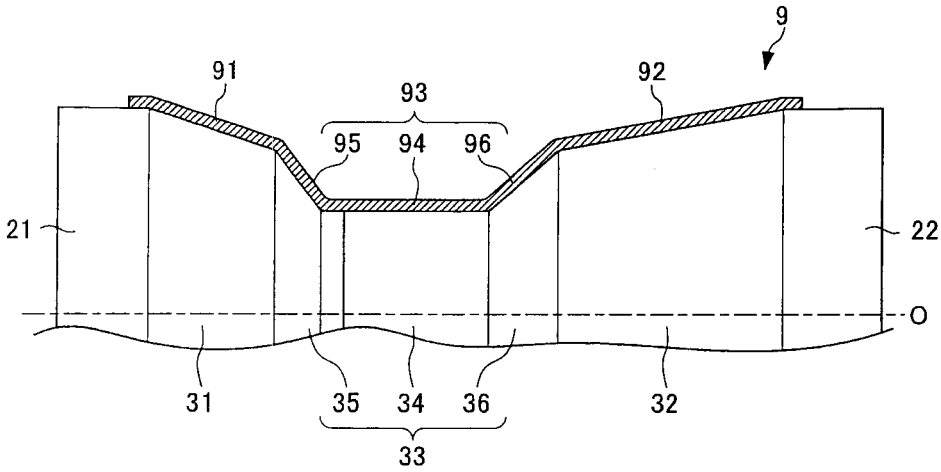
FIG. 7 is a cross-sectional view taken along an axis of a wheel rim fabricated by the spinning system according to the second exemplary embodiment.

FIG. 7 is a cross-sectional view taken along the axis O of a wheel rim 9 fabricated by the spinning system 1. As illustrated in FIG. 7, first and second tapered portions 31 and 32, increased in diameter outward, are formed at the left side of FIG. 7 in the first split die 21 and at the right side of FIG. 7 in the second split die 22, respectively. Further, with the first and second split dies 21 and 22 butted against each other, a drop portion 33, having a concave shape as viewed in cross section along the direction of the axis O, is formed between the first and second tapered portions 31 and 32. Furthermore, the drop portion 33 includes: a bottom face part 34 provided with an outer surface substantially parallel to the central axis O; and first and second drop wall parts 35 and 36 formed at both sides of the bottom face part 34 along the direction of the axis O.

The wheel rim 9 is provided by forming a workpiece along the outer surfaces of the split dies 21 and 22 butted against each other. The wheel rim 9 includes: a drop portion 93 formed along an outer surface of the drop portion 33 of the split dies 21 and 22; a first tapered portion 91 formed along an outer surface of the first tapered portion 31 of the first split die 21; and a second tapered portion 92 formed along an outer surface of the second tapered portion 32 of the second split die 22. Further, the drop portion 93 more specifically includes: a bottom face part 94 formed along an outer surface of the bottom face part 34; a first drop wall part 95 formed along an outer surface of the first drop wall part 35; and a second drop wall part 96 formed along an outer surface of the second drop wall part 36.

Referring again to FIG. 6, using the axis O as the central axis, the rotating device 3 rotates the first split die 21 together with the workpiece W and the second split die 22. Using, as the central axis, an axis substantially parallel to the axis O, the roller moving device 6 rotatably holds the disc-like roller R, and moves the roller R in a three-dimensional space. The compressing device 4 presses the second split die 22 toward the first split die 21 with a predetermined thrust along the direction of the axis O.

Next, a specific procedure of a spinning method performed by the above-described spinning system 1 will be described. FIGS. 8 to 14 are cross-sectional views illustrating states of the workpiece W and the split dies 21 and 22 in respective steps. The spinning method according to the second exemplary embodiment includes: a fixing step (see FIGS. 8 and 9) for fixing the workpiece W to the split dies 21 and 22 provided inwardly thereof; and a forming step (see FIGS. 10 to 14) for pressing the roller R to the outer surface of the workpiece W toward the central axis O while rotating the workpiece W together with the split dies 21 and 22, and for rotating the roller R along the outer surface of the workpiece W, thereby forming the workpiece W into a shape along the outer surfaces of the split dies 21 and 22. The respective steps will be described in sequence below.

<Fixing Step>

Figure 8:
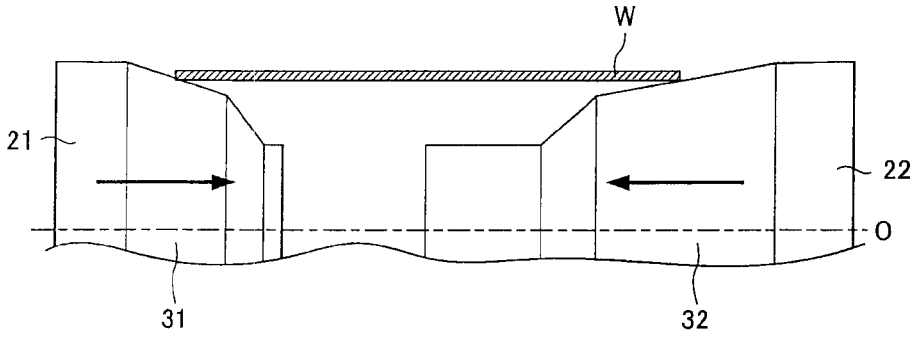
FIG. 8 is a cross-sectional view illustrating states of a workpiece and split dies in a fixing step according to the second exemplary embodiment.
Figure 9:
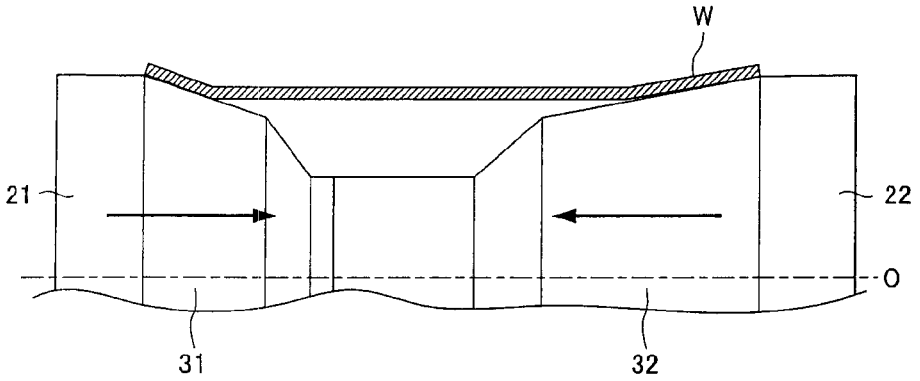
FIG. 9 is a cross-sectional view illustrating states of the workpiece and split dies in the fixing step according to the second exemplary embodiment.

In the fixing step, first, the first and second split dies 21 and 22 are inserted into the workpiece W through ends thereof. The split dies 21 and 22 are provided with the first and second tapered portions 31 and 32, respectively, each having an outer diameter larger than an inner diameter of the workpiece W before forming. Therefore, upon insertion of the split dies 21 and 22 into the workpiece W, the ends of the workpiece W butt against the tapered portions 31 and 32 as illustrated in FIG. 8. In this state, upon pushing of the second split die 22 toward the first split die 21 until the split dies 21 and 22 butt against each other, the ends of the workpiece W are brought into intimate contact with the outer surfaces of the tapered portions 31 and 32 while being expanded in accordance with taper angles of the tapered portions 31 and 32. Thus, the workpiece W is supported at its expanded portions by the split dies 21 and 22. Furthermore, the workpiece W is fixed to the split dies 21 and 22 while being expanded by the tapered portions 31 and 32 as described above, thus allowing the workpiece W to be always coaxial with the central axis O. Hence, the workpiece W will always be fixed at the same position with respect to the split dies 21 and 22.

<Forming Step>

The forming step of the second exemplary embodiment includes: a first forming step (see FIGS. 10 and 11) for forming, in the workpiece W, the bottom face part 94 along the outer surface of the bottom face part 34 of the split dies 21 and 22 with the use of the roller R; and a second forming step (see FIGS. 12 to 14) for forming, in the workpiece W in which the bottom face part 94 has been formed, the first drop wall part 95 and the first tapered portion 91 along the outer surfaces of the first drop wall part 35 and the first tapered portion 31 of the split die 21, and the second drop wall part 96 and the second tapered portion 92 along the outer surfaces of the second drop wall part 36 and the second tapered portion 32 of the split die 22 with the use of the roller R.

<First Forming Step>

Figure 10:
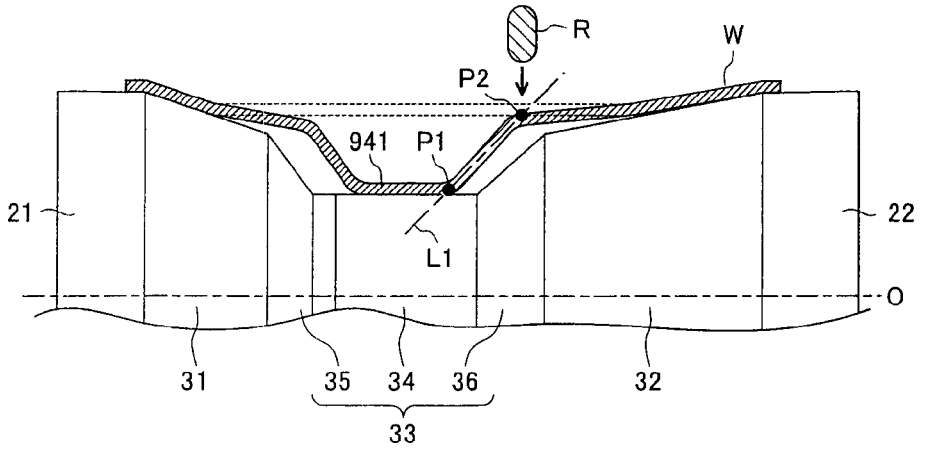
FIG. 10 is a cross-sectional view illustrating states of the workpiece and split dies in a first forming step according to the second exemplary embodiment.
Figure 11:
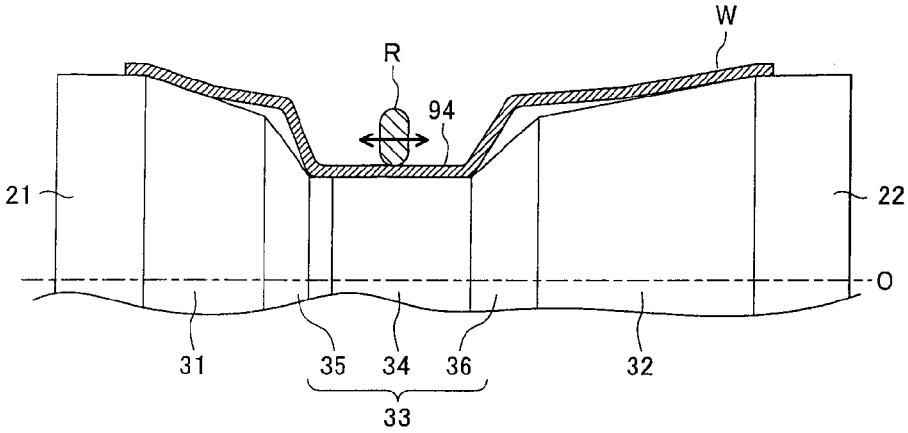
FIG. 11 is a cross-sectional view illustrating states of the work piece and split dies in the first forming step according to the second exemplary embodiment.
Figure 12:
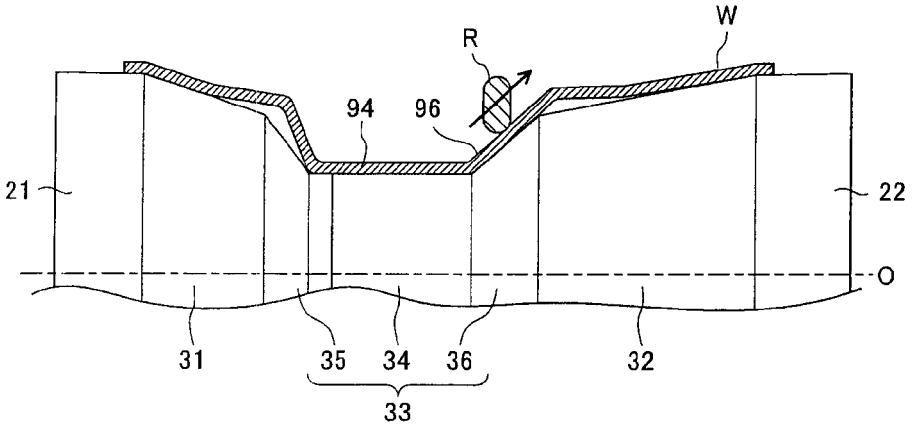
FIG. 12 is a cross-sectional view illustrating states of the workpiece and split dies in a second forming step according to the second exemplary embodiment.
Figure 13:
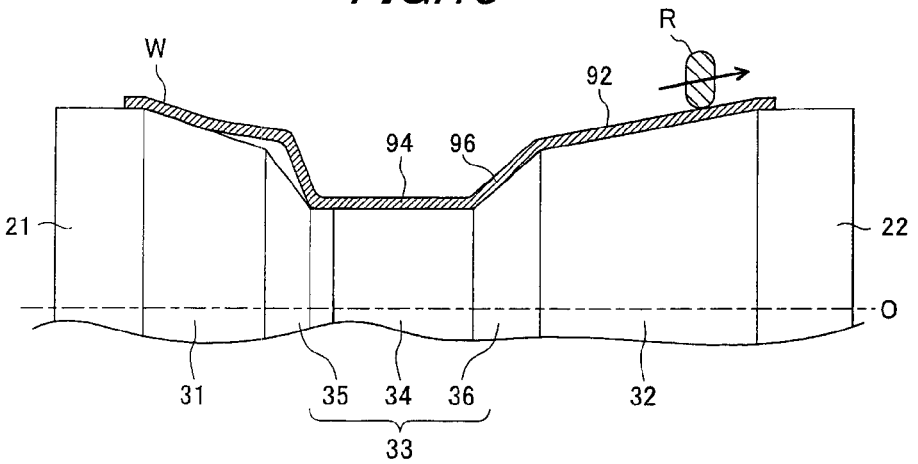
FIG. 13 is a cross-sectional view illustrating states of the workpiece and split dies in the second forming step according to the second exemplary embodiment.
Figure 14:
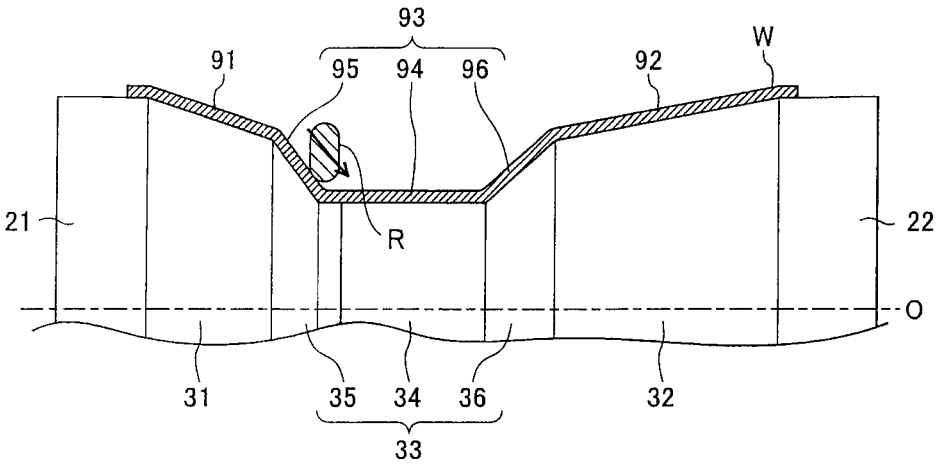
FIG. 14 is a cross-sectional view illustrating states of the workpiece and split dies in the second forming step according to the second exemplary embodiment.

In the first forming step, first, the workpiece before forming, indicated by the broken lines in FIG. 10, is subjected to shrinking by the roller R so that a portion 941 of the workpiece W, serving as a material constituting the bottom face part, butts against the outer surface of the bottom face part 34 of the split dies 21 and 22 as illustrated in FIG. 10. Next, as illustrated in FIG. 11, the roller R is reciprocated along the direction of the axis O, thereby performing ironing on the portion 941 butted against the outer surface of the bottom face part 34 of the split dies 21 and 22. Thus, the portion butted against the outer surface of the bottom face part 34 is extended along the direction of the axis O, and the bottom face part 94 is formed in the workpiece W. Furthermore, an insertion position of the roller R at the start of the first forming step is determined as a position P2 at an intersection of: a straight line L1 that starts from an end P1 (at the right side of FIG. 10) of the portion 941 butted against the outer surface of the bottom face part 34, and that is substantially in parallel to the outer surface of the second drop wall part 36 of the second split die 22; and the workpiece before forming, which is indicated by the broken lines in FIG. 10.

<Second Forming Step>

In the second forming step, drawing is performed (see FIGS. 12 and 13) on the workpiece W in which the bottom face part 94 has already been formed, and then ironing is further performed (see FIG. 14) on the workpiece W, thereby forming the drop wall parts and tapered portions at both sides of the bottom face part 94.

In the foregoing first forming step, the bottom face part 94 is formed in the workpiece W by performing ironing, thus bringing the workpiece W to a state in which the thickness of the workpiece W is increased at both sides of the bottom face part 94. Therefore, in the second forming step, the thickness increased at both sides of the bottom face part 94 is moved toward both end portions of the workpiece W by performing drawing on the workpiece W. Specifically, drawing is performed on the workpiece W as follows. The roller R is moved from the bottom face part 94 toward the end portion adjacent to the second split die 22 in such a manner that the workpiece W runs along the outer surfaces of the second drop wall part 36 and second tapered portion 32 of the second split die 22. Thus, the second drop wall part 96 and the second tapered portion 92 are formed in the workpiece W while the thickness increased at the side of the bottom face part 94, adjacent to the second split die 22, is moved toward the end portion of the workpiece W by the spinning tool R (see FIGS. 12 and 13). Next, drawing is performed on the workpiece W as follows. The roller R is moved from the bottom face part 94 toward the end portion adjacent to the first split die 21 in such a manner that the workpiece W runs along the outer surfaces of the first drop wall part 35 and first tapered portion 31 of the first split die 21. Thus, the first drop wall part 95 and the first tapered portion 91 are formed in the workpiece W while the thickness increased at the side of the bottom face part 94, adjacent to the first split die 21, is moved toward the end portion of the workpiece W by the spinning tool R.

Next, ironing is performed on the workpiece W on which the above-described drawing has been carried out. Specifically, while the roller R is pressed toward the central axis O, the roller R is moved from the end portion of the workpiece W, adjacent to the first split die 21, toward the bottom face part 94, thereby performing ironing on the first tapered portion 91 and first drop wall part 95 of the workpiece W. Thus, plate thicknesses of the first tapered portion 91 and first drop wall part 95 are adjusted while the workpiece W is extended toward the end portion (see FIG. 14). Subsequently, while the roller R is pressed toward the central axis O, the roller R is moved from the end portion of the workpiece W, adjacent to the second split die 22, toward the bottom face part 94, thereby performing ironing on the second tapered portion 92 and second drop wall part 96 of the workpiece W. Thus, plate thicknesses of the second tapered portion 92 and second drop wall part 96 are adjusted while the workpiece W is extended toward the end portion.

The second exemplary embodiment achieves the following effects.

(1) According to the second exemplary embodiment, when the workpiece is fixed at a predetermined position of the split dies 21 and 22, at least part of the workpiece is expanded, and the expanded part is supported by the split dies 21 and 22. The workpiece W can be brought into intimate contact with the split dies 21 and 22 by expanding the workpiece in this manner. Therefore, a frictional force acted between the workpiece and the split dies 21 and 22 is utilized, and the workpiece can be fixed to the split dies 21 and 22 without the use of any clamp. Further, the workpiece is fixed by utilizing the frictional force, thereby allowing the workpiece to be fixed at the predetermined position of the split dies 21 and 22 without preventing extension of the workpiece W. Furthermore, it is unnecessary to fix the workpiece to the die by a clamp, a plate and the like; hence, as compared with a conventional method, a cycle time can be reduced by a time required for attachment and detachment of the workpiece.

(2) According to the second exemplary embodiment, the first and second split dies 21 and 22 provided with the first and second tapered portions 31 and 32, respectively, each having an outer diameter larger than the inner diameter of the workpiece, are inserted into the workpiece through the ends thereof. Then, the end portions of the workpiece are brought into intimate contact with the tapered portions 31 and 32 while being expanded by the respective tapered portions 31 and 32 of the split dies 21 and 22, thereby fixing the workpiece at the predetermined position of the split dies 21 and 22. Thus, the workpiece can be fixed to the first and second split dies 21 and 22 while being coaxial with the first and second split dies 21 and 22, and therefore, the workpiece can be always fixed at the same position with respect to the split dies 21 and 22.

(3) According to the second exemplary embodiment, the bottom face part 94 is formed in the workpiece along the outer surface of the bottom face part 34 of the split dies 21 and 22 with the use of the roller R. Then, with the use of the roller R, the drop wall parts 95 and 96 are formed in the workpiece along the outer surfaces of the drop wall parts 35 and 36 of the split dies 21 and 22, and the tapered portions 91 and 92 are formed in the workpiece along the outer surfaces of the tapered portions 31 and 32. In this manner, before forming the drop wall parts 95 and 96 and the tapered portions 91 and 92, the bottom face part 94, which is the deepest part, is formed. Thus, the drop wall parts 95 and 96 and the tapered portions 91 and 92 can be formed with the workpiece fitted into the bottom face part 34 of the split dies 21 and 22, and therefore, a positional deviation of the workpiece along the direction of the axis O can be suppressed during forming. According to the second exemplary embodiment, since the workpiece is fixed to the split dies 21 and 22 by utilizing the frictional force as mentioned above, the extension of the workpiece, which occurs along the direction of the axis O in the first and second forming steps, will not be prevented, and in addition, a positional deviation of the workpiece along the direction of the axis O is suppressed. Furthermore, since ironing is performed with the workpiece partially butted against the outer surface of the bottom face part 34 of the split dies 21 and 22, a frictional force is acted between the workpiece and the split dies 21 and 22, and therefore, a positional deviation of the workpiece with respect to the split dies 21 and 22 can be suppressed. Besides, according to the second exemplary embodiment, the insertion position of the roller R at the start of the first forming step is determined as the position P2 at an intersection of: the straight line L1 that starts from one end P1 of the portion 941 of the yet-to-be-ironed workpiece, butted against the outer surface of the bottom face part 34 of the split dies 21 and 22, and that is substantially in parallel to the outer surface of the second drop wall part 36 of the second split die 22; and the workpiece before forming. In other words, the insertion position of the roller R at the start of the first forming step is equivalent to an end of a portion that becomes the drop portion 93 as a result of the forming. Hence, the accuracy of material position management can be enhanced.

(4) According to the second exemplary embodiment, when the workpiece W, in which the bottom face part 94 has been formed by executing the first forming step, is subjected to drawing in the second forming step, the roller R is moved from the bottom face part 94 of the workpiece W toward the end portion thereof. Thus, the thickness, pulled toward both ends of the bottom face part 94 of the workpiece W when the bottom face part 94 is formed in the first forming step, can be moved toward the drop wall parts 95 and 96 and the tapered portions 91 and 92, and therefore, an excess thickness can be prevented.

(5) According to the second exemplary embodiment, when ironing is performed in the second forming step, the roller R is moved from the end portion of the workpiece W toward the bottom face part 94 thereof, thereby making it possible to adjust the plate thicknesses of the drop wall parts 95 and 96 and the tapered portions 91 and 92 while efficiently extending the workpiece W along the direction of the axis O. Further, when ironing is performed, the workpiece W is extended in a direction opposite to a traveling direction of the roller R. Therefore, buckling will not occur in the bottom face part 94, and the workpiece W will not rise from the surfaces of the split dies 21 and 22.

It should be noted that although a spinning method for forming a workpiece using a single roller has been described in the second exemplary embodiment, the number of rollers to be used is not limited to this, but may be two or more.

Figure 15:
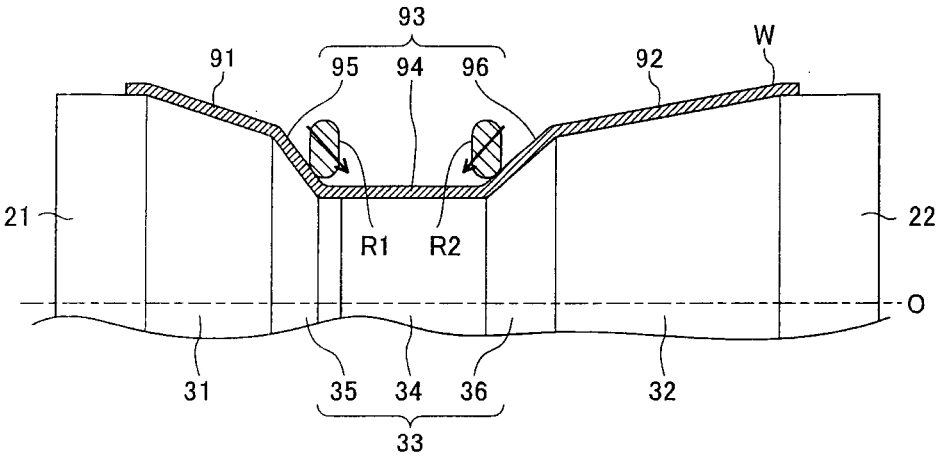
FIG. 15 is a cross-sectional view illustrating states of the workpiece and split dies in the second forming step in which two rollers are used.

Referring to FIG. 15, an example in which the second forming step is performed using two rollers, i.e., first and second rollers R1 and R2, will be described. FIG. 15 is a cross-sectional view illustrating states of the workpiece and split dies in the second forming step in which the two rollers R1 and R2 are used.

When the two rollers R1 and R2 are used in performing ironing on the workpiece W in the second forming step, the first roller R1 is moved from one end (adjacent to the first split die 21) of the workpiece W, defined with respect to the direction of the axis O, toward the bottom face part 94 as illustrated in FIG. 15, thereby forming the first tapered portion 91 and the first drop wall part 95. On the other hand, the second roller R2 is moved from the other end (adjacent to the second split die 22) of the workpiece W, defined with respect to the direction of the axis O, toward the bottom face part 94, thereby forming the second tapered portion 92 and the second drop wall part 96.

In this case, in addition to the foregoing effects (1) to (4), the following effects are achieved.

(6) According to the second exemplary embodiment, the first and second rollers R1 and R2 are moved from the end portions of the workpiece W toward the bottom face part 94, thereby making it possible to adjust the plate thicknesses of the drop wall parts 95 and 96 and the tapered portions 91 and 92 while efficiently extending the workpiece W along the direction of the axis O. Further, since the workpiece W is extended in the directions opposite to the traveling directions of the rollers R1 and R2 when ironing is performed, buckling will not occur in the bottom face part 94, and the workpiece W will not rise from the surfaces of the split dies 21 and 22. Furthermore, the ironing is performed simultaneously using the two rollers R1 and R2, thereby making it possible to efficiently extend the workpiece W toward both ends thereof and to efficiently perform machining on the workpiece W in a short time.

Third Exemplary Embodiment

Figure 16:
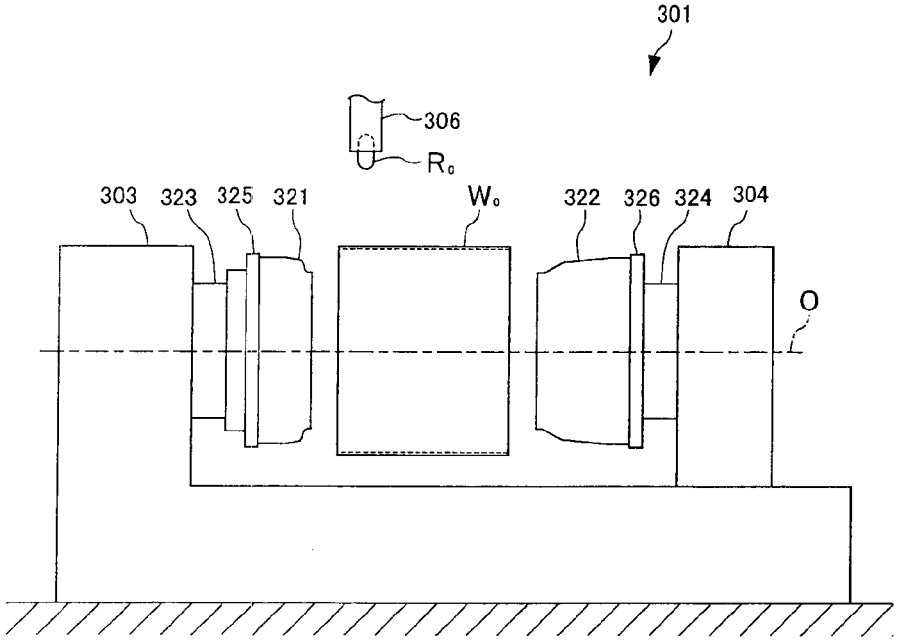
FIG. 16 is a schematic diagram illustrating a structure of a spinning system to which a spinning method according to a third exemplary embodiment of the present invention is applied.

FIG. 16 is a schematic diagram illustrating a structure of a spinning system 301 to which a spinning method according to a third exemplary embodiment of the present invention is applied.

The spinning system 301 includes: first and second split dies 321 and 322 for holding a cylindrical workpiece $W_o$; a rotating device 303 for rotating the workpiece $W_o$; a compressing device 304 for compressing the workpiece $W_o$; a roller moving device 306 for moving a roller (spinning tool) $R_o$; and a control board (not illustrated) for controlling the entire system.

As will be described in detail below, in the spinning system 301, the roller $R_o$ is brought into contact with an outer surface of the workpiece $W_o$ rotated around an axis O serving as a central axis, thereby shrinking the workpiece $W_o$ and forming the workpiece $W_o$ into a shape along outer surfaces of the split dies 321 and 322. A cylindrical body, fabricated by shrinking the workpiece $W_o$ using the spinning system 301, is used for an automobile wheel rim, for example.

The first and second split dies 321 and 322 are provided at the left side of FIG. 16 and the right side of FIG. 16, respectively, along the same axis O. The outer surface of the first split die 321 has a shape conforming to a left side shape of a wheel rim, and the outer surface of the second split die 322 has a shape conforming to a right side shape of the wheel rim. Accordingly, the dies 321 and 322 are butted against each other, thereby providing a die having a shape conforming to that of the wheel rim.

The first split die 321 is connected to the rotating device 303 via a support strut 323, and the second split die 322 is connected to the compressing device 304 via a support strut 324. A left end flange portion 325 and a right end flange portion 326 are formed at the left end side of the first split die 321 and at the right end side of the second split die 322, respectively, against which left and right ends of the workpiece $W_o$ are butted. The workpiece $W_o$ is fixed with its ends butted against the flange portions 325 and 326. It should be noted that the first and second split dies 321 and 322 may be provided with clamps for fixing the ends of the workpiece $W_o$.

Figure 17:
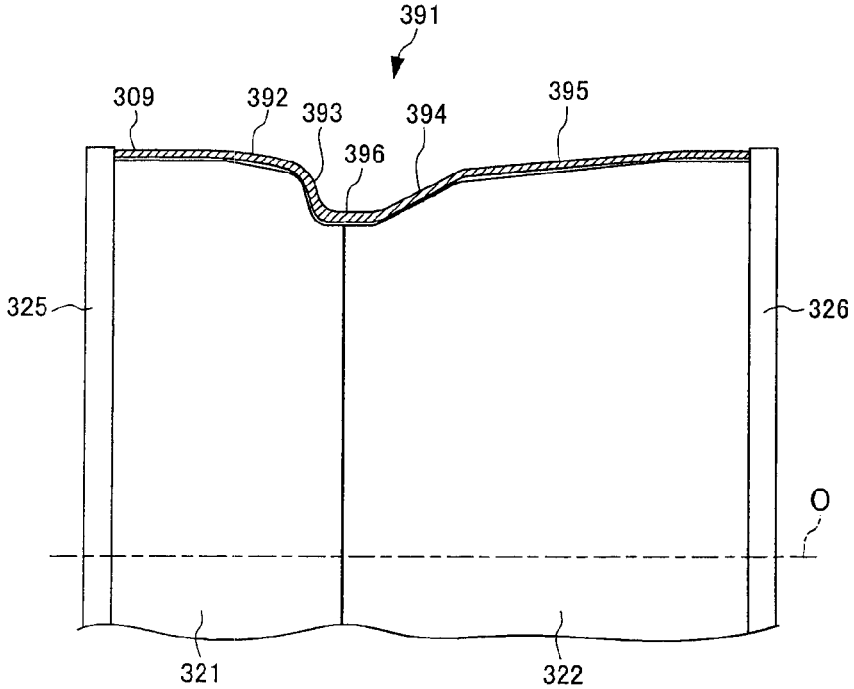
FIG. 17 is a cross-sectional view taken along an axis O of a wheel rim fabricated by the spinning system according to the third exemplary embodiment.

FIG. 17 is a cross-sectional view taken along the axis O of a wheel rim 309 fabricated by the spinning system 301. As illustrated in FIG. 17, the wheel rim 309 is provided by forming a workpiece along the outer surfaces of the split dies 321 and 322 butted against each other. At an approximate center of the wheel rim 309, a concave reduced diameter part 391 is provided. More specifically, as viewed in cross section along the direction of the axis O, the reduced diameter part 391 includes: a first tapered portion 392; a second tapered portion 393 reduced in diameter at a taper angle larger than that of the first tapered portion 392; a straight portion 396 extended in parallel to the axial direction; a third tapered portion 394; and a fourth tapered portion 395 increased in diameter at a taper angle smaller than that of the third tapered portion 394. Of these tapered portions 392 to 395, the second tapered portion 393 has the largest taper angle. Therefore, the maximum acute angle of the wheel rim 309 is formed between the second tapered portion 393 and the straight portion 396.

Referring again to FIG. 16, using the axis O as the central axis, the rotating device 303 rotates the first split die 321 together with the workpiece $W_o$ and the second split die 322. Using, as the central axis, an axis substantially parallel to the axis O, the roller moving device 306 rotatably holds the disc-like roller $R_o$, and moves the roller $R_o$ in a three-dimensional space. The compressing device 304 presses the second split die 322 toward the first split die 321 with a predetermined thrust along the direction of the axis O. Thus, with the workpiece $W_o$ set to the split dies 321 and 322, a compressive force acts on the workpiece $W_o$ along the direction of the axis O.

Next, a specific procedure of a spinning method performed by the above-described spinning system 301 will be described. FIGS. 18 to 21 are cross-sectional views illustrating states of the workpiece $W_o$ and the split dies 321 and 322 in respective steps.

Figure 18:
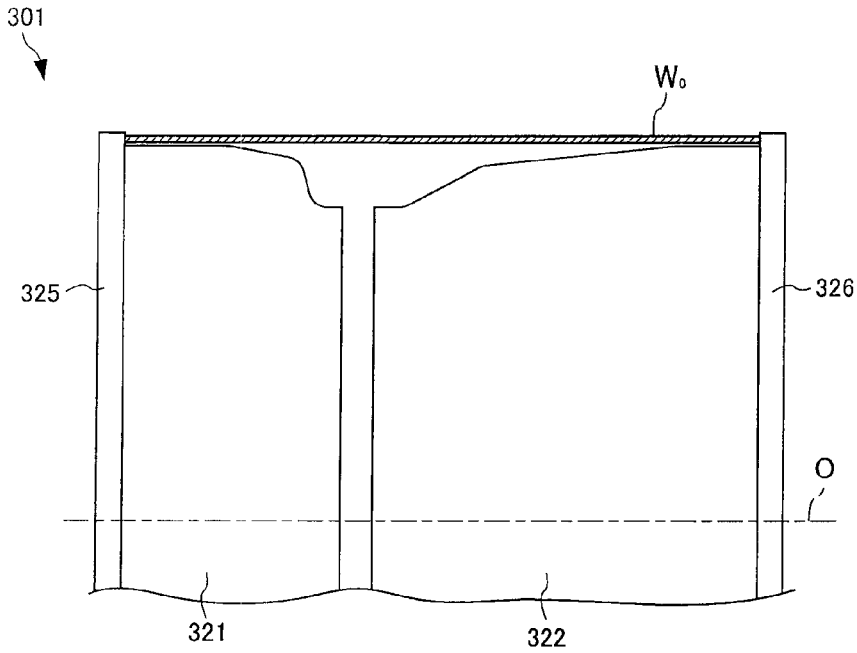
FIG. 18 is a cross-sectional view illustrating states of a workpiece and split dies in a step of the spinning method according to the third exemplary embodiment.

First, as illustrated in FIG. 18, the workpiece $W_o$ is set to the split dies 321 and 322. More specifically, the left end side of the workpiece $W_o$ is fixed by being butted against the flange portion 325 of the first split die 321, and the right end side of the workpiece $W_o$ is fixed by being butted against the flange portion 326 of the second split die 322, thereby clamping the workpiece $W_o$ between the flange portions 325 and 326. Next, the second split die 322 is moved toward the first split die 321 with a predetermined thrust along the axis O, thereby applying a compressive force of a predetermined magnitude to the workpiece $W_o$ from the ends thereof. Then, the first split die 321 is rotated around the axis O serving as the central axis, thereby rotating the workpiece $W_o$ while applying the compressive force thereto.

Figure 19:
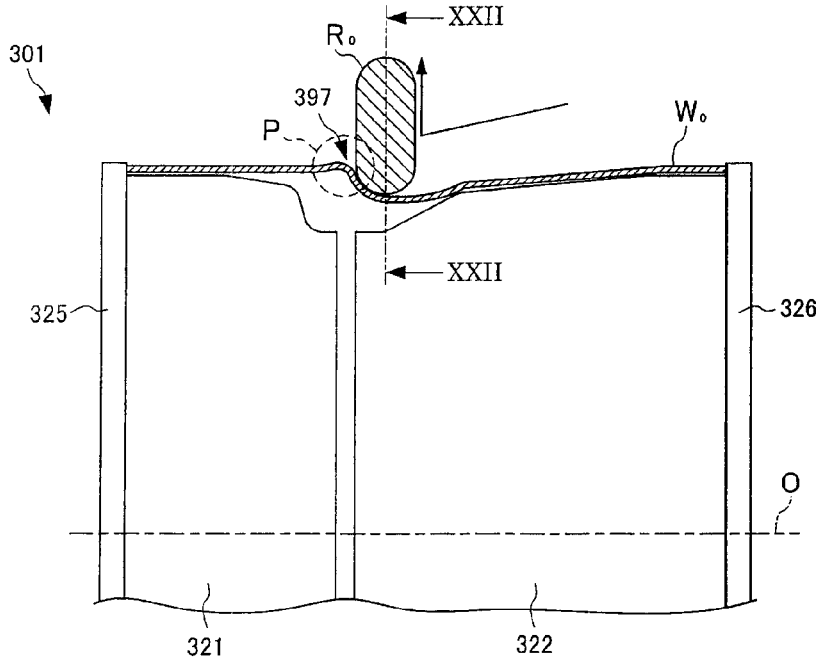
FIG. 19 is a cross-sectional view illustrating states of the workpiece and split dies in another step of the spinning method according to the third exemplary embodiment.
Figure 20:
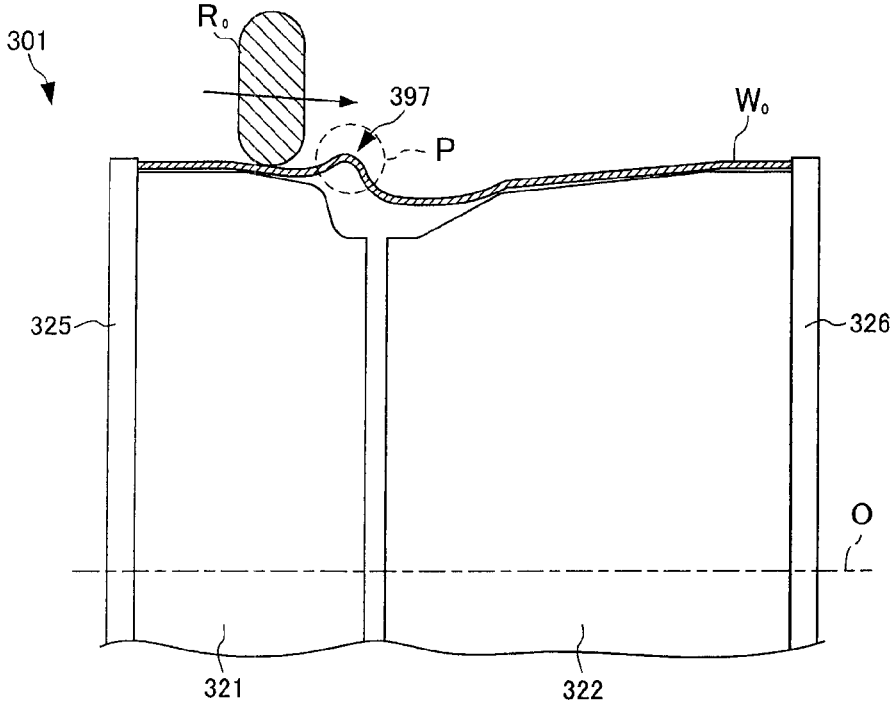
FIG. 20 is a cross-sectional view illustrating states of the workpiece and split dies in still another step of the spinning method according to the third exemplary embodiment.
Figure 21:
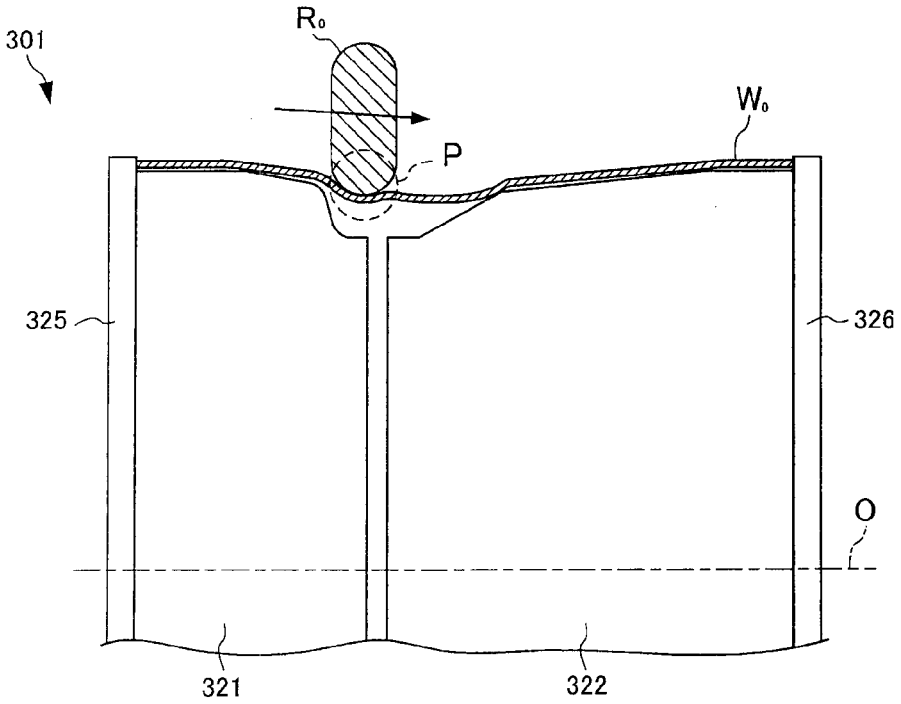
FIG. 21 is a cross-sectional view illustrating states of the workpiece and split dies in yet another step of the spinning method according to the third exemplary embodiment.

Thereafter, while the roller $R_o$ is pressed against the outer surface of the rotated workpiece $W_o$ from the outer surface thereof toward the central axis O in the procedure illustrated in FIGS. 19 to 21, the second split die 322 is brought close to the first split die 321. Thus, as illustrated in FIG. 17, the workpiece $W_o$ is reduced in diameter, and is formed into a product shape conforming to the shape of outer surfaces of the split dies 321 and 322. Actually, as mentioned above, in accordance with the resulting product shape, a reduction in the diameter of the cylindrical workpiece $W_o$ causes: a portion in which the plate thickness is increased as a result of redundancy of material due to shrinkage of the workpiece $W_o$ in the radial direction; and a portion in which the plate thickness is reduced as a result of deficiency of material due to extension of the workpiece along the direction of the central axis O. In particular, in the example of the third exemplary embodiment, a thin thickness portion is likely to be caused between the second tapered portion 393 and the straight portion 396 in the resulting product (see FIG. 17).

Therefore, in the spinning method of the third exemplary embodiment, a region of the product, in which a thin thickness portion will be caused, is taken into consideration, and thickening machining for increasing the thickness of a specific region of the workpiece before completion of the forming, which becomes a thin thickness portion as a result of the forming, is carried out at an early stage of the forming. Hereinafter, a specific procedure of the thickening machining will be described.

The thickening machining is mainly divided into the following three steps: a first step; a second step; and a third step. First, in the first step, the roller $R_o$ is moved from the second split die 322 toward the first split die 321 along the direction of the axis O while the roller $R_o$ is pressed from the outer surface of the workpiece $W_o$ toward the central axis O thereof as illustrated in FIG. 19. Subsequently, in the second step, when the roller $R_o$ reaches the specific region of the workpiece $W_o$, the movement of the roller $R_o$ is stopped and the roller $R_o$ goes away from the workpiece $W_o$. Thus, a raised portion 397 raised radially outward is formed in the specific region P of the workpiece $W_o$ at the early stage of the forming.

Figure 22:
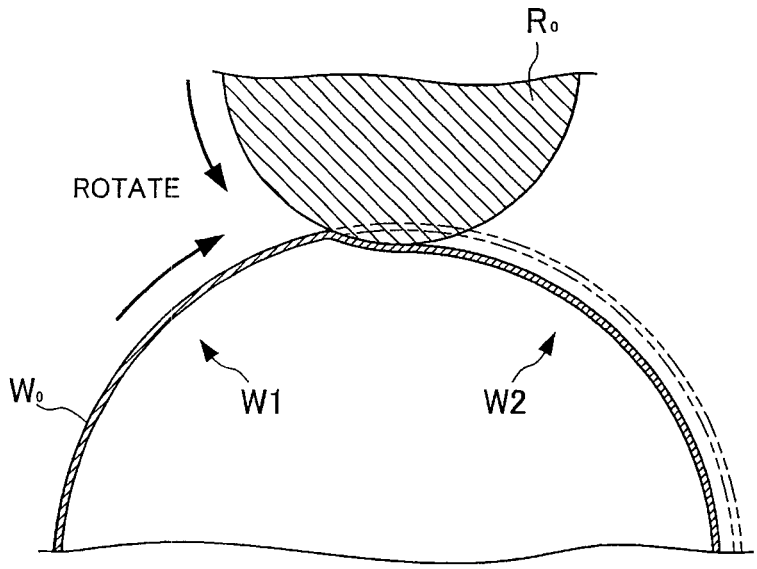
FIG. 22 is a cross-sectional view taken along the line XXII-XXII of FIG. 19.
Figure 23:
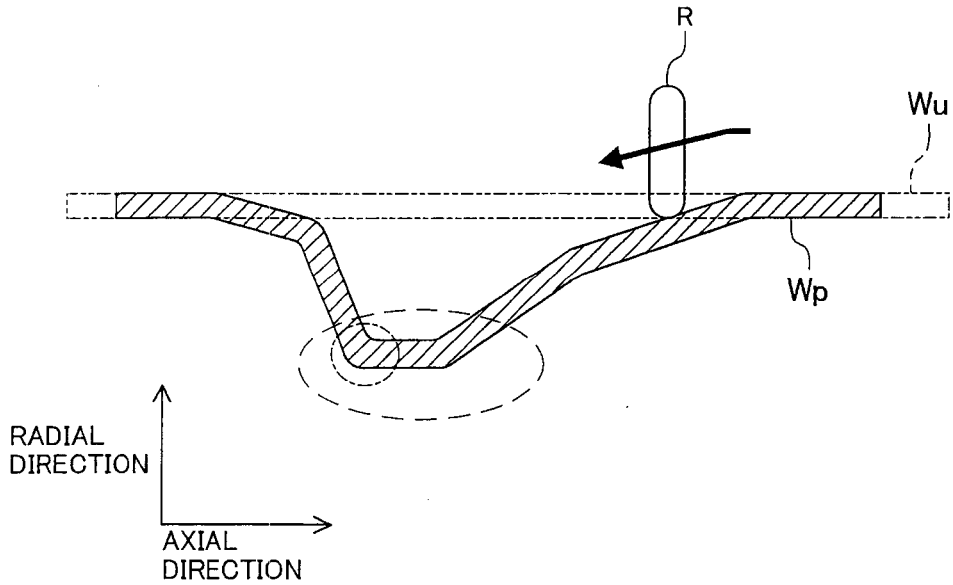
FIG. 23 is a cross-sectional view illustrating structures of a workpiece before machining and a workpiece after machining.

Hereinafter, the reason why the raised portion 397 is formed in the specific region P by carrying out the above-described machining at the early stage of the forming will be described. FIG. 22 is a cross-sectional view taken along the line XXII-XXII of FIG. 19.

As illustrated in FIG. 22, upon pressing of the roller $R_o$ against the rotated workpiece $W_o$, the roller $R_o$ is rotated along the outer surface of the workpiece $W_o$, and the workpiece $W_o$ will be successively shrunk. At a stage at which radial deformation of the workpiece $W_o$ is shallow, the increase of material due to reduction in diameter of the workpiece $W_o$ is greater than the reduction of material due to extension of the workpiece $W_o$ along the axial direction. Furthermore, since the workpiece $W_o$ is compressed along the axial direction by the first and second split dies as mentioned above, the extension of the workpiece $W_o$ along the axial direction is restricted. Therefore, a plate thickness of a portion W2, which is shrunk by the roller $R_o$, is greater than that of a portion W1, which is not shrunk by the roller $R_o$.

However, when the workpiece $W_o$ is shrunk to a depth greater than a predetermined depth, the foregoing plate thickness increase is not enough to follow a volume change resulting from the shrinkage, thus causing a circumferential length difference in the workpiece $W_o$. At this time, the workpiece $W_o$ is compressed along the axial direction, and no post-machining hardening occurs in the workpiece $W_o$ at a portion thereof in front of the traveling direction of the roller $R_o$; hence, the raised portion 397 is formed in the specific region P as illustrated in FIG. 19.

Next, in the third step, while the roller $R_o$ is pressed against the workpiece $W_o$ toward the central axis O, the roller $R_o$ is moved from a portion of the workpiece $W_o$, closer to the first split die 321 than the raised portion 397, toward the second split die 322 along the direction of the axis O as illustrated FIG. 20, and the raised portion 397 is compressed toward the central axis O by the roller $R_o$ as illustrated in FIG. 21. As mentioned above, a compressive force is applied to the workpiece $W_o$ along the direction of the axis O, and the extension of material along the direction of the axis O is restricted. Therefore, the thickness of the specific region P is increased by a reduction in the circumferential length upon compression of the raised portion 397.

As described above, in the thickening machining according to the third exemplary embodiment, the raised portion 397 is formed so that the circumferential length of the specific region P is increased, and the specific region P is increased in diameter. Then, the raised portion 397 is compressed so that the circumferential length of the specific region P is reduced again, and the specific region P is reduced in diameter, thus making it possible to increase the thickness of the specific region P in accordance with the extension of the circumferential length.

After the specific region P of the workpiece $W_o$ has been increased in thickness by carrying out the foregoing thickening machining, the roller $R_o$ will be pressed against the workpiece $W_o$ toward the central axis O in the predetermined procedure, thereby forming the workpiece $W_o$ into a shape along the outer surfaces of the split dies 321 and 322. In this case, although the specific region P whose thickness has been increased is thinned in the course of forming of the workpiece $W_o$ into the shape of the split dies 321 and 322, the plate thickness of the resulting wheel rim can be uniformized by making the thickness of the specific region P greater than that of other portions in advance.

The third exemplary embodiment achieves the following effects.

(1) The roller $R_o$ is moved toward the first split die 321 along the direction of the axis O while being pressed against the workpiece $W_o$ toward the central axis O. When the roller $R_o$ reaches the specific region P of the workpiece $W_o$, the movement of the roller $R_o$ is stopped, and the roller $R_o$ goes away from the workpiece $W_o$. Thus, the raised portion 397 raised radially outward can be formed in the specific region P. Then, while the roller $R_o$ is pressed against the workpiece $W_o$ toward the central axis O, the roller $R_o$ is moved from a portion of the workpiece $W_o$, closer to the first split die 321 than the raised portion 397, toward the second split die 322 along the direction of the axis O, thereby compressing the raised portion 397. In this manner, the raised portion 397 is formed so that the circumferential length of the specific region P is increased, and the specific region P is increased in diameter. Then, the raised portion 397 is compressed so that the circumferential length of the specific region P is reduced again, and the specific region P is reduced in diameter, thus making it possible to increase the thickness of the specific region P in accordance with the temporary extension of the circumferential length. In this case, in anticipation of a plate thickness reduction resulting from the forming, the foregoing thickening machining is performed on the workpiece $W_o$ at the early forming stage prior to the forming of the workpiece $W_o$ into a product shape, thereby allowing the plate thickness of the resulting product to be uniformized. Furthermore, since no thin thickness portion occurs in the resulting product, a workpiece having a plate thickness smaller than that of a conventional one can be used while necessary strength is ensured.

(2) In the first and second steps, the roller $R_o$ is moved along the direction of the axis O while the workpiece $W_o$ is compressed, thus facilitating the formation of the raised portion 397 at a roller movement destination, i.e., in the specific region P of the workpiece $W_o$. Furthermore, in the third step, a material constituting the raised portion 397 can be restrained within the specific region P by compressing the workpiece $W_o$ along the direction of the axis O. Therefore, when the raised portion 397 is compressed and shrunk toward the central axis O, the thickness of the specific region P can be more reliably increased.

While description has been made in connection with specific exemplary embodiments and modified examples thereof, it will be obvious to those skilled in the art that various changes and modifications may be made therein without departing from the present invention. It is aimed, therefore, to cover in the appended claims all such changes and modifications falling within the true spirit and scope of the present invention.

DESCRIPTION OF REFERENCE NUMERALS AND SIGNS

1 . . . spinning system
21 . . . first split die
22 . . . second split die
31 . . . first tapered portion (increased-diameter portion of die)
32 . . . second tapered portion (increased-diameter portion of die)
33 . . . drop portion
34 . . . bottom face part
35 . . . first drop wall part (die wall part)
36 . . . second drop wall part (die wall part)
9 . . . wheel rim
91 . . . first tapered portion (increased-diameter portion)
92 . . . second tapered portion (increased-diameter portion)
93 . . . drop portion
94 . . . bottom face part
95 . . . first drop wall part (wall part)
96 . . . second drop wall part (wall part)
R . . . roller (spinning tool)
R1 . . . first roller (first spinning tool)
R2 . . . second roller (second spinning tool)
110 . . . cylindrical body
112 . . . rim
114 . . . die
124 . . . first equal diameter portion
126 . . . first inclined portion
128 . . . first tapered portion
130 . . . first small diameter part
132 . . . second small diameter part
134 . . . second tapered portion
136 . . . second inclined portion
138 . . . second equal diameter portion
140 . . . small diameter portion
144 . . . clamp claw
146 . . . roller
148 . . . tapered increased-diameter portion
150 . . . tapered reduced-diameter portion
152 . . . large taper angle reduced-diameter portion
154 . . . large taper angle increased-diameter portion
156 . . . concave portion
158, 160 . . . constant diameter portion
301 . . . spinning system
321 . . . first split die
322 . . . second split die
309 . . . wheel rim
397 . . . raised portion
$R_o$ . . . roller (spinning tool)
P . . . specific region

What is claimed is:

1. A spinning method for forming a concave portion dented in a radial direction of a cylindrical workpiece by pressing a spinning tool against a side wall portion of the cylindrical workpiece, the method comprising the steps of:

a) attaching the workpiece to a die, the die including a first equal diameter portion having a constant diameter, a second equal diameter portion having a constant diameter and located away from the first equal diameter portion, a first inclined portion continuous with the first equal diameter portion, a second inclined portion continuous with the second equal diameter portion, a small diameter portion interposed between the first inclined portion and second inclined portion and having a constant diameter, and a workpiece movement preventing portion for preventing a movement of the workpiece from the first inclined portion toward the second inclined portion, the first inclined portion being reduced in diameter in a tapered manner as the first inclined portion goes away from the first equal diameter portion, the second inclined portion being increased in diameter in a tapered manner as the second inclined portion comes close to the second equal diameter portion;

b) pressing the spinning tool to a region of the workpiece corresponding to the first inclined portion, and displacing the spinning tool from the first inclined portion toward the second inclined portion, thereby forming the region into a shape conforming to a shape of the first inclined portion;

c) pressing the spinning tool to a region of the workpiece corresponding to the second inclined portion, and displacing the spinning tool from the second inclined portion toward the first inclined portion, thereby forming the region into a shape conforming to a shape of the second inclined portion;

d) pressing the spinning tool to a region of the workpiece corresponding to the small diameter portion, and displacing the spinning tool, thereby forming the region into a shape conforming to that of the small diameter portion, and performing ironing on a thickness of the region by the spinning tool so that the thickness of the region is drawn;

performing the step b) before the step c) and the step d); and forming, on the workpiece, a first constant diameter portion conforming to the first equal diameter portion; a tapered reduced-diameter portion having a shape conforming to that of the first inclined portion; a concave portion having a shape conforming to that of the small diameter portion; a tapered increased-diameter portion having a shape conforming to that of the second inclined portion; and a second constant diameter portion conforming to the second equal diameter portion.

2. The spinning method according to claim 1, further comprising:

using a clamp mechanism as the workpiece movement preventing portion; and clamping only one end portion of the workpiece located adjacent to the second equal diameter portion by the clamp mechanism.

3. The spinning method according to claim 1, wherein the die includes: a first tapered portion having a taper angle larger than that of the first inclined portion and located between the first inclined portion and the small diameter portion; and a second tapered portion having a taper angle larger than that of the second inclined portion and located between the small diameter portion and the second inclined portion, the method further comprising:

forming a large taper angle reduced-diameter portion having a taper angle larger than that of the tapered reduced-diameter portion in a region of the workpiece corresponding to the first tapered portion; and forming a large taper angle increased-diameter portion having a taper angle larger than that of the tapered increased-diameter portion in a region of the workpiece corresponding to the second tapered portion.

4. The spinning method according to claim 1, wherein a wheel rim is obtained by forming the workpiece.

* * * * *